US008980515B2

(12) United States Patent
Mizobe et al.

(10) Patent No.: US 8,980,515 B2
(45) Date of Patent: Mar. 17, 2015

(54) MAGNETIC TONER FOR ELECTROSTATIC LATENT IMAGE DEVELOPMENT

(71) Applicant: KYOCERA Document Solutions Inc., Osaka (JP)

(72) Inventors: Takeo Mizobe, Osaka (JP); Yukinori Nakayama, Osaka (JP); Hiroaki Moriyama, Osaka (JP); Takanori Tanaka, Osaka (JP); Hiroki Uemura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 13/962,861

(22) Filed: Aug. 8, 2013

(65) Prior Publication Data

US 2014/0045114 A1 Feb. 13, 2014

(30) Foreign Application Priority Data

Aug. 9, 2012 (JP) ..... 2012-177243
Aug. 30, 2012 (JP) ..... 2012-190635

(51) Int. Cl.
*G03G 9/093* (2006.01)
*G03G 9/08* (2006.01)
*G03G 9/083* (2006.01)

(52) U.S. Cl.
CPC ..... *G03G 9/09314* (2013.01); *G03G 9/0819* (2013.01); *G03G 9/0838* (2013.01); *G03G 9/09392* (2013.01)
USPC ..... 430/110.1; 430/110.2

(58) Field of Classification Search
USPC ..... 430/110.1, 110.2
See application file for complete search history.

(56) References Cited

U.S. PATENT DOCUMENTS

2006/0210899 A1* 9/2006 Nakazawa et al. ..... 430/106.1
2008/0166156 A1* 7/2008 Kawase ..... 399/222
2009/0297225 A1* 12/2009 Yamada et al. ..... 399/252
2010/0266947 A1* 10/2010 Maezawa ..... 430/110.2

(Continued)

FOREIGN PATENT DOCUMENTS

JP 2002-108003 A 4/2002
JP 2011-070179 A 4/2011
JP 2011-150229 A 4/2011

(Continued)

OTHER PUBLICATIONS

Notice of Reasons for Rejection issued to corresponding JP Application No. 2012-177243, mailed Aug. 12, 2014.

*Primary Examiner* — Hoa V Le
(74) *Attorney, Agent, or Firm* — Knobbe Martens Olson & Bear LLP

(57) ABSTRACT

A magnetic toner for electrostatic latent image development includes toner particles containing toner core particle containing at least a binder resin and a magnetic powder, and a shell layer coating the toner core particle. In the toner, in the case where the surfaces of the shell layers are observed using a scanning electron microscope, the magnetic powder is not observed, and approximately spherical particles derived from the resin fine particles are not observed on the surfaces of the shell layers for toner particles having a particle diameter in a specific range. In the toner, in the case where the cross-sectional surfaces of the toner particles are observed using a transmission electron microscope, cracks approximately perpendicular to surfaces of the toner core particles are observed inside the shell layers.

6 Claims, 5 Drawing Sheets

(56) References Cited

U.S. PATENT DOCUMENTS

2011/0053071 A1 3/2011 Miki et al.
2011/0305984 A1* 12/2011 Tominaga et al. ..... 430/108.4

FOREIGN PATENT DOCUMENTS

JP 2012-018206 A 1/2012
JP 2012-137717 A 7/2012

* cited by examiner

MAGNETIC TONER FOR ELECTROSTATIC LATENT IMAGE DEVELOPMENT

INCORPORATION BY REFERENCE

This application is based upon and claims the benefit of priority from the corresponding Japanese Patent Application Nos. 2012-177243 and 2012-190635 respectively filed in the Japan Patent Office on Aug. 9, 2012, and Aug. 30, 2012, the entire contents of which are incorporated herein by reference.

FIELD

The present disclosure relates to a magnetic toner for electrostatic latent image development.

BACKGROUND

In electrophotography, generally, a surface of a latent image bearing member is charged using a process such as corona discharge followed by exposure using laser to form an electrostatic latent image. The resulting electrostatic latent image is developed by a toner to form a toner image. An image with high quality can be obtained by transferring the resulting toner image on a recording medium. Typically, toner particles (toner base particles) with an average particle diameter of from 5 μm to 10 μm, produced by mixing a binder resin such as a thermoplastic resin with toner components such as a colorant, a charge control agent, a release agent, and a magnetic material and then passing the mixture through the steps of kneading, pulverizing, and classifying, are used for the toner applied to such electrophotography. In addition, in order to provide flowability or appropriate charging performance to the toner or to facilitate cleaning of the toner from surfaces of photoconductor drums, silica and/or inorganic fine particles such as those of titanium oxide are externally added to the toner base particles.

A two-component developing system using a toner and a carrier such as an iron powder, and a magnetic single-component developing system using only a toner containing toner particles containing a magnetic powder inside without using a carrier, are known as dry developing processes in various electrophotographic systems that are currently in practical use. The toner containing toner particles containing a magnetic powder (hereinafter also referred to as a magnetic toner) used in the magnetic single-component developing system has advantages such as low cost and excellent durability.

Furthermore, from the standpoint of energy saving, toners containing toner particles each having a core-shell structure in which a toner core particle using a low-temperature binder resin is coated with a shell material formed of a resin having a higher glass transition point (Tg) than the Tg of the binder resin contained in the toner core particle have been used conventionally to improve low-temperature fixability, storage stability at high temperatures and antiblocking properties.

As for toner which includes toner particles with such a core-shell structure, a toner which includes toner particles with a core-shell structure, composed of toner core particles containing a polyester resin or a resin where a polyester resin and a vinyl resin are bound and a shell layer consisting of a shell material containing a copolymer between styrene and a (meth)acrylic monomer containing a polyalkylene oxide unit, has been proposed. The toner particles with this core-shell structure are formed by coating a surface of toner core particles with resin fine particles dispersed in an aqueous medium in the presence of an organic solvent such as ethyl acetate.

However, in the shell layers of the toner particles in the toner, since contact sites of the resin fine particles themselves have been dissolved by the organic solvent, there remains almost no void between the resin fine particles and uniform films are formed in a condition that the shape of resin fine particles remains. Therefore, when forming images using the toner, the shell layer may be resistant to break during fixing images on recording media even when a pressure is applied to the toner particles in the toner. In cases where the shell layer cannot be easily broken, it is difficult to appropriately fix the toner on recording media.

Furthermore, in the case where the above-mentioned toner particles are used as magnetic toner particles by incorporating a magnetic powder into toner core particles, the toner particles are sometimes difficult to be charged at a desired charge amount in an environment of high temperature and high humidity, depending on the state of the shell layers. Therefore, in the case where an image is formed by using a toner containing magnetic toner particles each having a core-shell structure obtained by the above-mentioned method in an environment of ordinary temperature and ordinary humidity or an environment of high temperature and high humidity over a long time period, it is sometimes difficult to form an image having a desired image density. The defects related to image formation over a long time period are more significant in an environment of high temperature and high humidity.

SUMMARY

A magnetic toner for electrostatic latent image development of the present disclosure includes toner particles containing a toner core particle containing at least a binder resin and magnetic powder and a shell layer coating the toner core particles. The shell layer is formed using spherical resin fine particles. When surfaces of the toner particles are observed using a scanning electron microscope, the magnetic powder is unobservable on the surfaces of the shell layers of the toner particles, and the structures derived from the spherical resin fine particles are unobservable at the surface of the shell layers of the toner particles with respect to toner particles having a particle diameter from 6 μm to 8 μm. And when cross-sections of the toner particles are observed using a transmission electron microscope, cracks are observable inside the shell layer in which the cracks are approximately perpendicular to a surface of the toner core particle and originate at phase boundaries of the resin fine particles themselves.

DETAILED DESCRIPTION

The present disclosure is explained in detail with respect to embodiments thereof below; however, the present disclosure is not limited at all to the embodiments and may be carried out with appropriately making a change within the purpose of the present disclosure. In addition, explanation may be occasionally omitted with respect to duplicated matters; this does not however limit the gist of the present disclosure.

The toner particles included in the magnetic toner for electrostatic latent image development (hereinafter, also merely referred to as "toner") of the present disclosure contains a toner core particle containing at least a binder resin and a magnetic powder, and a shell layer coating the toner core particle. The shell layers coating the toner core particles are formed by using spherical resin fine particles. Although the toner of the present disclosure is composed only of toner particles, the toner may contain other constitutional components.

In the case where the surfaces of the toner particles included in the toner of the present disclosure are observed using a scanning electron microscope, structures derived from the spherical resin fine particles are not observed on the surfaces of the shell layers with respect to the toner particles each having a particle diameter of 6 μm or more and 8 μm or less. In the case where the cross-sections of the toner particles are observed using a transmission electron microscope, cracks that run in an approximately vertical direction with respect to the surface of the toner core particle and that originate from the boundaries of the resin fine particles are observed inside the shell layer. Hereinafter the structure of each toner particle and the materials for the toner particles will be explained.

Structure of Toner Particles

Figure 1:
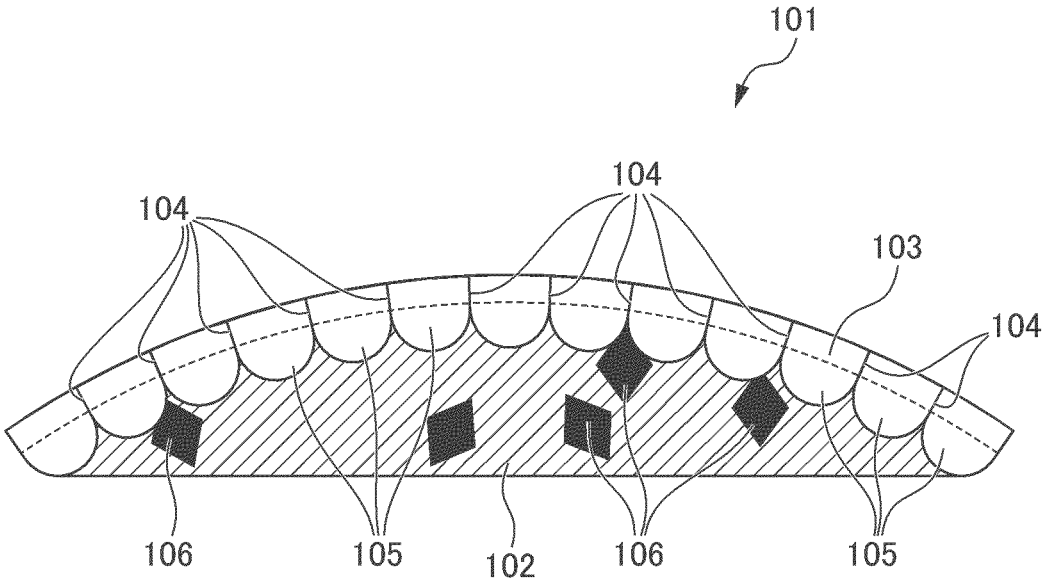
FIG. 1 is a view showing a partial cross-section of the toner particle in the toner of the present disclosure.

In the toner particles in the toner of the present disclosure, the entire surfaces of the toner core particles are coated with the shell layers. Surface conditions of the toner particles coated with the shell layers can be confirmed using a scanning electron microscope (SEM). Smoothened levels of the shell layers and inner structures of the shell layers of the toner particles can be confirmed by observing cross-sections of the toner particles using a transmission electron microscope (TEM). FIG. 1 shows a schematic cross-sectional view, which is observed using a TEM, of toner particle in the toner in accordance with one preferable embodiment of the present disclosure.

As shown in FIG. 1, in the toner particle 101 in the magnetic toner for electrostatic latent image development, the shell layer 103 covers the entire surface of the toner core particle 102. The shell layer is formed by smoothening an outer surface of a layer of resin fine particles, which has been formed by adhering the resin fine particles onto toner core particle, using an external force.

The thickness of the shell layer 103 is preferably from 0.03 μm to 1 μm, more preferably from 0.04 μm to 0.7 μm, particularly preferably from 0.045 μm to 0.5 μm, and most preferably from 0.045 μm to 0.3 μm. When the shell layer has convex parts, the shell layer may be uneven in its thickness, as described later. In cases where the shell layer is uneven in its thickness like this, the thickness at the thickest part of the shell layer is defined as "the thickness of the shell layer" in claims and specification of the present application.

When forming images using a toner which includes toner particles with an excessively thick shell layer, the shell layers are resistant to break even if a pressure is applied to the toner particles during fixing the toner to recording media. In this case, it is difficult to fix the toner in a low-temperature region since softening or melting of binder resins and/or release agents in toner core particles does not promptly proceed. On the other hand, an excessively thin shell layer leads to a lower strength. When the strength of the shell layer is low, the shell layer may be broken due to a shock occurring during a state like transportation. In cases where toners are stored at high temperatures, toner particles with a shell layer broken at least partially tend to agglomerate. The reason is that components such as a release agent tend to exude onto a surface of the toner particle through the site where the shell layer has been broken.

The thickness of the shell layer 103 may be measured by analyzing a TEM image of a cross-section of the toner particle 101 using commercially available image analysis software. Software such as WINROOF (by MITANI Co.) may be used as the commercially available image analysis software.

As shown in FIG. 1, preferably, the shell layer 103 has convex parts 105 between two cracks 104 on the phase boundary between the toner core particle 102 and the shell layer 103. By having such convex parts 105 in the shell layer 103, the contact area between the toner core particle 102 and the shell layer 103 is larger than that of the case where the shell layer has no convex part 105. Therefore, when the shell layer has the convex parts 105, the toner core particle 102 and the shell layer 103 appropriately adhere, and thus the shell layer 103 is unlikely to peel from the toner core particle 102. Therefore, by having the convex parts 105 in the shell layer 103, a toner with excellent heat-resistant storage stability can be obtained.

More specifically, the shell layer formed using resin fine particles is formed by a method including:

I) a step of making spherical resin fine particles adhere to the surface of toner core particle so as to not overlap in a direction perpendicular to the surface of toner core particles and forming a layer of the resin fine particles that covers the entire surface of the toner core particle, and II) a step of forming shell layers by applying an external force to the outer surface of the layer of the resin fine particles and deforming the resin fine particles in the layer of the resin fine particles to thereby smoothen the outer surface of the layer of the resin fine particles.

The smoothened level of the shell layer may be such a level that the structures derived from the spherical resin fine particles used for forming the shell layer cannot be observed at the outer surfaces of the shell layers of toner particles having a particle diameter from 6 μm to 8 μm when observing the surfaces of the toner particles using a scanning electron microscope. When the toner particles having a particle diameter from 6 μm to 8 μm represent such a condition in the shell layers, in almost all the toner particles in the toner, the shell layers have been formed such that the surfaces of the toner core particles are not exposed. In a case that the condition of outer surface of the shell layer is confirmed using the scanning electron microscope, the particle diameter of a toner particle is an equivalent circle diameter calculated from a projected area of the toner particle on an electron microscope image.

In the preferable embodiment of the shell layer shown in FIG. 1, the entire surface of the toner core particle 102 is coated by the shell layer 103. Since the shell layer 103 covers the entire surface of the toner core particle 102 such that its outer surface is smooth, components such as a release agent are unlikely to exude onto a surface of the toner particle 101 during storage of the toner particle 101 at high temperatures.

There are voids (cracks) 104 inside the shell layer 103. Therefore, when a pressure is applied to the toner for fixing the toner particles on recording media, the shell layer is likely to break from cracks as an origin. When the shell layer is promptly broken, then softening or melting of components such as a binder resin and a release agent in the toner core particles 102 promptly proceeds, thus the toner can be fixed on recording media at a temperature lower than heretofore.

As shown in FIG. 1, the toner particle 101 contains a magnetic powder 106 in the toner core particle 102, and the magnetic powder 106 is not observed on the surface of the shell layer 103 in the case where the toner particle 101 is observed using a scanning electron microscope. The magnetic powder 106 is a component that is essentially contained in the toner core particle 102, and the magnetic powder 106 is sometimes exposed on the surface of the toner core particle 102. In the case where a toner containing toner particles in which the magnetic powder 106 is exposed on the surfaces of the shell layers 103 is used, when an image is formed over a long time period, emission of an electrification charge from the edge lines or peaks of the magnetic powder 106 exposed on the surfaces of the particles readily occurs, and the charge amount of the toner particles readily decreases. The problem of the decrease in the charge amount of toner particles in the case where an image is formed over a long time period is significant under conditions of high temperature and high humidity.

However, in the toner particles 101, since the entire surfaces of the toner core particles 102 are coated with the shell layers 103, the magnetic powder 106 is not exposed on the surfaces of the shell layers 103. Therefore, even in the case where an image is formed over a long time period in an environment of high temperature and high humidity by using the toner particles 101, the charging state of the toner particles 101 is stable, and thus an image having a desired image density can be formed.

With respect to the toner particles, whether or not the magnetic powder is exposed on the surfaces of the shell layers can be confirmed by the following method.

Method for Confirming Whether or not Magnetic Powder was Exposed

The surfaces of at least 50 or more toner particles are observed by using an EDX (JSM-7600FA (manufactured by JEOL Ltd.)) attached to a scanning electron microscope in a visual field at 10,000× microscope magnification, and the elements are mapped by using an x-ray spectrometer. The surfaces of the 50 or more toner particles are analyzed by obtaining element-mapped images.

Material of Toner Particles

The toner particles in the toner are composed of toner core particles containing at least a binder resin and a magnetic powder, and the shell layers coating the entire surfaces of the toner core particles.

Where necessary, the toner core particles may contain components such as a release agent, a charge-control agent and a colorant besides the magnetic powder in the binder resin.

The surface of the toner particles may be treated using an external additive as required.

Hereinafter, the binder resin, the magnetic powder, the release agent, the charge control agent, the colorant, the resin fine particles for forming the shell layer, and external additives, which are essential or optional components to configure the toner particles, and a method of producing the toner particles are explained in order.

Binder Resin

The toner core particles contain a binder resin. The binder resin in the toner core particles is not particularly limited as long as it is a resin used heretofore as a binder resin for toners. Specific examples of the binder resin are thermoplastic resins such as polystyrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins. Among these resins, polystyrene resins and polyester resins are preferable from the viewpoints of charging ability of the toner, and fixability on paper. Hereinafter, the polystyrene resin and the polyester resin are explained.

The polystyrene resin may be a styrene homopolymer or a copolymer between styrene and other copolymerization monomers copolymerizable with styrene. Specific examples of the other copolymerization monomers copolymerizable with styrene are p-chlorostyrene; vinylnaphthalene; ethylenically unsaturated monoolefins such as ethylene, propylene, butylene, and isobutylene; halogenated vinyls such as vinyl chloride, vinyl bromide, and vinyl fluoride; vinyl esters such as vinyl acetate, vinyl propionate, vinyl benzoate, and vinyl butyrate; (meth)acrylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, and butyl methacrylate; other acrylic acid derivatives such as acrylonitrile, methacrylonitrile, and acrylamide; vinyl ethers such as vinyl methyl ether and vinyl isobutyl ether; vinyl ketones such as vinyl methyl ketone, vinyl ethyl ketone, and methyl isopropenyl ketone; and N-vinyl compounds such as N-vinyl pyrrole, N-vinyl carbazole, N-vinyl indole, and N-vinyl pyrrolidene. These copolymerization monomers may be copolymerized with styrene monomer in a combination of two or more.

The polyester resin may be those obtained through condensation polymerization or co-condensation polymerization of bivalent, trivalent or higher-valent alcohol components and bivalent, trivalent or higher-valent carboxylic acid components. The components used for synthesizing the polyester resin may be exemplified by the alcohol components and the carboxylic acid components below.

Specific examples of the divalent, trivalent or higher-valent alcohols may be exemplified by diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent or higher-valent carboxylic acids include divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azealic acid, malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These divalent, trivalent or higher-valent carboxylic acids may be used as ester-forming derivatives such as an acid halide, an acid anhydride, and a lower alkyl ester. Here, the term "lower alkyl" means an alkyl group of from 1 to 6 carbon atoms.

When the binder resin is a polyester resin, the softening point of the polyester resin is preferably from 70° C. to 130° C. and more preferably 80° C. to 120° C.

In a case that the toner is used as a magnetic one-component developer, preferably, a resin having at least one functional group selected from the group consisting of hydroxyl group, carboxyl group, amino group, and epoxy group (glycidyl group) in its molecule is used as the binder resin. By use of the binder resin having these functional groups in its molecule, dispersibility of components such as a magnetic powder and a charge control agent in the binder resin can be improved. Presence or absence of these functional groups can be confirmed using a Fourier transform infrared spectrophotometer (FT-IR). The amount of these functional groups in the resins can be measured using conventional processes such as titration.

A thermoplastic resin is preferable as the binder resin since a toner with an appropriate fixability to paper may be easily obtained; here, the thermoplastic resin may be used together with a cross-linking agent and/or a thermosetting resin. By adding the cross-linking agent and/or the thermosetting resin and introducing a partial cross-linked structure into the binder resin, heat-resistant storage stability and durability of the toner may be improved without degrading the fixability of the toner. When a thermosetting resin is used together with the thermoplastic resin, the amount of cross-linked part (gel amount) in the binder resin extracted using a Soxhlet extractor is preferably no greater than 10% by mass and more preferably from 0.1% to 10% by mass based on the mass of the binder resin.

The thermosetting resin usable together with the thermoplastic resin is preferably epoxy resins and cyanate resins. Specific examples of preferable thermosetting resins are bisphenol A-type epoxy resins, hydrogenated bisphenol A-type epoxy resins, novolak-type epoxy resins, polyalkylene ether-type epoxy resins, cyclic aliphatic-type epoxy resins, and cyanate resins. These thermosetting resins may be used in a combination of two or more.

The glass transition point (Tg) of the binder resin is preferably from 40° C. to 70° C. A toner which includes toner particles obtained using a binder resin with an excessively high glass transition point tends to exhibit poor low-temperature fixability. A toner which includes toner particles obtained using a binder resin with an excessively low glass transition point tends to exhibit poor heat-resistant storage stability.

The glass transition point of the binder resin can be determined from a changing point of specific heat of the binder resin using a differential scanning calorimeter (DSC). More specifically, the glass transition point of the binder resin can be determined by measuring an endothermic curve using a differential scanning calorimeter (DSC-6200, by Seiko Instruments Inc.) as a measuring device. 10 mg of a sample to be measured is loaded into an aluminum pan and an empty aluminum pan is used as a reference. The glass transition point of the binder resin can be determined from an endothermic curve of the binder resin that is obtained by measuring under a measuring temperature range of from 25° C. to 200° C., a temperature-increase rate of 10° C./min, and normal temperature and normal humidity.

The mass average molecular mass (Mw) of the binder resin is preferably from 20,000 to 300,000 and more preferably from 30,000 to 200,000. The mass average molecular mass (Mw) of the binder resin can be determined using gel permeation chromatography (GPC) based on a calibration curve previously prepared using standard polystyrene resins.

When the binder resin is a polystyrene resin, preferably, the binder resin has a peak in a region of lower molecular masses and a peak in a region of higher molecular masses respectively in terms of molecular mass distribution measured by a means such as gel permeation chromatography. Specifically, the peak of molecular mass in a region of lower molecular masses is preferably within a range from 3,000 to 20,000 and the peak of molecular mass in a region of higher molecular masses is preferably within a range from 300,000 to 1,500,000. It is preferred for the polystyrene resin having such a molecular mass distribution that a ratio (Mw/Mn) of a mass average molecular mass (Mw) to a number average molecular mass (Mn) is at least 10. By use of the binder resin having a peak respectively in a region of lower molecular masses and a region of higher molecular masses, a toner excellent in low-temperature fixability and allowing to suppress high-temperature offset can be obtained.

Magnetic Powder

The toner core particles contain a magnetic powder in the binder resin.

The magnetic powder may be exemplified by iron oxides such as ferrite and magnetite, ferromagnetic metals such as those of cobalt and nickel, alloys of iron and/or ferromagnetic metals, compounds of iron and/or ferromagnetic metals, ferromagnetic alloys via ferromagnetizing treatment like heat-treatment, and chromium dioxide.

The particle diameter of the magnetic powder is preferably from 0.05 μm to 1.00 μm.

In the case where the toner core particles are prepared by using a magnetic powder having a particle diameter in such a range, the magnetic powder is readily and homogeneously dispersed in the binder resin, and the magnetic powder is difficult to expose on the surfaces of the shell layer. Therefore, even in the case where an image is formed in an environment of ordinary temperature and ordinary humidity or an environment of high temperature and high humidity over a long time period, the toner particles are readily charged at a desired charge amount. Therefore, an image having a desired image density can be formed.

In the case where toner core particles are prepared by using a magnetic powder having excessively small average particle diameter, it is difficult to finely disperse the magnetic powder in the toner core particles. Therefore, the charging amount of the toner particles tends to be inhomogeneous, and thus it is difficult to form a thin layer of toner on the surface of the sleeve of the developing roller of the developing apparatus. In the case where toner core particles are prepared by using a magnetic powder having excessively large average particle diameter and shell layers are formed on the surfaces of toner core particles, the magnetic powder exposes readily on the surfaces of the shell layers. In this case, emission of the electrification charge of the toner particle from the edge lines or peaks of the magnetic powder exposed on the surfaces of the shell layer occurs readily, and the charge amount of the toner particle readily decreases in an environment of high temperature and high humidity, and thus an image having a desired image density is difficult to form.

In order to improve dispersibility into the binder resin, the magnetic powder surface-treated with a surface treatment agent such as a titanium coupling agent and/or a silane coupling agent may also be used.

The amount of the magnetic powder used is preferably from 35% to 65% by mass and more preferably from 35% to 55% by mass based on the total mass of the toner core particles. In cases of using a toner, which includes toner particles composed of toner core particles where the content of the magnetic powder is excessively large and a shell layer coating the toner core particles, it may be difficult to form images with an intended image density when forming images continuously for a long period or fixability may be extremely deteriorated. In cases of using a toner, which includes toner particles composed of toner core particles where the content of the magnetic powder is excessively small and a shell layer coating the toner core particles, fogging tends to occur in the resulting images or image density of resulting images may be decreased when printing images for a long period.

Release Agent

The toner core particles preferably contain a release agent in order to improve fixability and offset resistance. The release agent is preferably a wax. Examples of the wax include carnauba wax, synthetic ester wax, polyethylene wax, polypropylene wax, fluorine resin wax, Fischer-Tropsch wax, paraffin wax, montan wax, and rice wax. These release agents may be used in a combination of two or more. The occurrence of offset and/or image smearing (smear around images occurring upon rubbing the images) may be more effectively suppressed by adding the release agent to the toner.

In cases where a polyester resin is used as the binder resin, preferably, at least one release agent selected from the group consisting of carnauba wax, synthetic ester wax, and polyethylene wax is used from the viewpoint of compatibility between the binder resin and the release agent. In cases where a polystyrene resin is used as the binder resin, preferably, Fischer-Tropsch wax and/or paraffin wax is used similarly from the viewpoint of compatibility between the binder resin and the release agent.

The Fischer-Tropsch wax is a linear hydrocarbon compound, produced by Fischer-Tropsch reaction of a catalytic hydrogenation reaction of carbon monoxide, which has a small content of iso-structural molecules and/or side chains.

Among Fischer-Tropsch waxes, those having a mass average molecular mass of 1,000 or higher and exhibiting a bottom temperature in endothermic peaks observed by DSC measurement within a range from 100° C. to 120° C. are more preferable. Such a Fischer-Tropsch wax may be exemplified by Sasol Wax C1 (bottom temperature in endothermic peaks: 106.5° C.), Sasol Wax C105 (bottom temperature in endothermic peaks: 102.1° C.), and Sasol Wax SPRAY (bottom temperature in endothermic peaks: 102.1° C.) which are available from Sasol Wax GmbH.

The amount of the release agent used is preferably from 1% to 10% by mass based on the total mass of the toner core particles. When using a toner which includes toner particles in which the content of the release agent is excessively small, the desired effect for suppressing the occurrence of offset or image smearing in the resulting images may not be obtained. A toner which includes toner particles with an excessively large content of the release agent may degrade the heat-resistant storage stability of the toner since toner particles tend to agglomerate.

Charge Control Agent

Preferably, the toner core particles contain a charge control agent for the purpose of improving a charged level or a charge-increasing property, which is an indicator of chargeability to a predetermined charged level within a short time, of the toner particles, to thereby obtain a toner excellent in durability and stability. When the toner particles in the toner are positively charged to develop, a positively chargeable charge control agent is used; and when the toner particles in the toner are negatively charged to develop, a negatively chargeable charge control agent is used.

The charge control agent may be appropriately selected from conventional charge control agents used for toners heretofore. Specific examples of the positively chargeable charge control agent are azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine FastRed FC, azine FastRed 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amines; alkylamides; quaternary ammonium salts such as benzylmethylhexyldecyl ammonium, and decyltrimethylammonium chloride. Among these positively chargeable charge control agents, nigrosine compounds are particularly preferable since a more rapid charge-increasing property may be obtained. These positively chargeable charge control agents may be used in a combination of two or more.

Resins having a quaternary ammonium salt, a carboxylic acid salt, or a carboxyl group as a functional group may also be used as the positively chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group may be exemplified. These resins may be an oligomer or a polymer.

Among the resins usable as the positively chargeable charge control agent, styrene-acrylic resins having a quaternary ammonium salt as a functional group are more preferable since the charged amount may be easily controlled within a desired range. In regards to the styrene-acrylic resins having a quaternary ammonium salt as a functional group, preferable specific examples of acrylic comonomers copolymerized with a styrene unit are (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

The units derived from dialkylamino alkyl(meth)acrylates, dialkyl(meth)acrylamides, or dialkylamino alkyl(meth)acrylamides through a quaternizing step may be used as the quaternary ammonium salt. Specific examples of the dialkylamino alkyl(meth)acrylate are dimethylamino ethyl(meth)acrylate, diethylamino ethyl(meth)acrylate, dipropylamino ethyl(meth)acrylate, and dibutylamino ethyl(meth)acrylate; a specific example of the dialkyl(meth)acrylamide is dimethyl methacrylamide; and a specific example of the dialkylamino alkyl(meth)acrylamide is dimethylamino propylmethacrylamide. Additionally, hydroxyl group-containing polymerizable monomers such as hydroxy ethyl(meth)acrylate, hydroxy propyl(meth)acrylate, 2-hydroxy butyl(meth)acrylate, and N-methylol (meth)acrylamide may also be used in combination at the time of polymerization.

Specific examples of the negatively chargeable charge control agent are organic metal complexes, chelate compounds, monoazo metal complexes, acetylacetone metal complexes, aromatic hydroxycarboxylic acids, metal complexes of aromatic dicarboxylic acids, aromatic monocarboxylic acids, aromatic polycarboxylic acids, and metal salts, anhydrides, or esters thereof, and phenol derivatives such as bisphenol. Among these, organic metal complexes and chelate compounds are preferable. Among organic metal complexes and chelate compounds, acetylacetone metal complexes such as aluminum acetylacetonate and iron(II) acetylacetonate and salicylic acid metal complexes or salicylic acid metal salts such as 3,5-di-tert-butylsalicylic acid chromium are more preferable, and salicylic acid metal complexes or salicylic acid metal salts are particularly preferable. These negatively chargeable charge control agents may be used in a combination of two or more.

The amount of the positively or negatively chargeable charge control agent used is preferably from 0.1% to 10% by mass based on the total mass of the toner core particles. In cases of using a toner, which includes toner particles where the content of the charge control agent is excessively small, image density of the resulting images may be lower than a desired value or it may be difficult to maintain image density of the resulting images for a long period since it is difficult to stably charge the toner particles in a predetermined polarity. Moreover, in cases where the content of the charge control agent is excessively small in the toner particles, since it is difficult to uniformly disperse the charge control agent in the binder resin, fogging tends to occur in the resulting images or smear caused by toner components tends to occur in latent image bearing members. In cases of using a toner, which includes toner particles where the content of the charge control agent is excessively large, smear caused by toner components tends to occur in latent image bearing members or image defects due to an inferior charge under high temperature and high humidity caused by degradation of environmental resistance tend to occur in the resulting images.

Colorant

Since the toner particles contained in the toner of the present disclosure contain the magnetic powder as an essential component, they are generally black. Therefore, the toner core particles may contain a known dye or pigment as a colorant for the purpose of adjusting the hue of the formed image to a more preferable black color. Examples of the colorant may include pigments such as carbon black, and dyes such as acid violet.

The amount of the colorant used is preferably from 1% to 10% by mass and more preferably from 2% to 7% by mass based on the total mass of the toner core particles.

The colorant may also be used as a master batch where the colorant has been previously dispersed in a resin material such as a thermoplastic resin. When using the colorant as a master batch, the resin in the master batch is preferably of the same type as that of the binder resin.

Resin Fine Particles

The resin fine particles for forming the shell layer are not particularly limited as long as they can coat the toner core particles. The resin fine particles for forming the shell layer are preferably a polymer of a monomer having an unsaturated bond since a shell layer with a predetermined structure may be easily formed.

The monomer having an unsaturated bond is not particularly limited as long as it is a monomer from which a resin having sufficient physical properties as the shell layer can be synthesized. The monomer having an unsaturated bond is preferably a vinyl monomer. The vinyl group in the vinyl monomer may be substituted at α-site thereof with an alkyl group. The vinyl group in the vinyl monomer may also be substituted with a halogen atom. The alkyl group, which the vinyl group may have, is preferably an alkyl group of from 1 to 6 carbon atoms, more preferably methyl or ethyl group, and particularly preferably methyl group. The halogen atom, which the vinyl group may have, is preferably chlorine or bromine atom and more preferably chlorine atom.

As the resin fine particles used for forming the shell layers, resin fine particles formed of a resin containing a charge-control resin are more preferable. In the case where a toner containing toner particles having shell layers formed of a resin containing a charge-control resin is used, the toner particles can be charged at a desired charge amount in the case where an image is formed in environments such as an environment of ordinary temperature and ordinary humidity and an environment of high temperature and high humidity over a long time period, and in the case where image formation is stopped once and thereafter image formation is restarted during formation of the image in environments such as an environment of ordinary temperature and ordinary humidity and an environment of high temperature and high humidity. Therefore, an image having a desired image density can be formed.

In the case where a resin including a charge-control resin is used for the resin fine particles, a toner that can be charged at a desired charge amount can be obtained even when a charge-control agent is not incorporated in the toner core particles or when the amount of charge-control agent incorporated in the toner core particles is decreased.

In the case where resin fine particles formed of a resin containing a charge-control resin are used, the charge-control resin used as the resin fine particles is preferably a copolymer of a monomer having a chargeable functional group that imparts chargeability to the resin and an unsaturated bond, and a monomer having no chargeable functional group but having an unsaturated bond. Monomers having a nitrogen-containing polar functional group such as a quaternary ammonium group and an unsaturated bond are preferable as the monomer having a chargeable functional group and an unsaturated bond used in the case where positive chargeability is imparted to the resin. Monomers having a fluorine-substituted hydrocarbon group or a sulfo group and an unsaturated bond are preferable as the monomer having a chargeable functional group and an unsaturated bond used in the case where negative chargeability is imparted to the resin.

Among vinyl monomers, specific examples of the monomer having no nitrogen-containing polar functional group, fluorine-substituted hydrocarbon group or sulfo group are styrenes such as styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-ethoxystyrene, p-phenylstyrene, p-chlorostyrene, and 3,4-dichlorostyrene; ethylenically unsaturated monoolefins such as ethylene, propylene, butylene, and isobutylene; halogenated vinyls such as vinyl chloride, vinylidene chloride, vinyl bromide, and vinyl fluoride; vinyl esters such as vinyl acetate, vinyl propionate, vinyl benzoate, and vinyl butyrate; (meth)acrylic acid esters such as methyl (meth)acrylate, ethyl (meth)acrylate, n-butyl (meth)acrylate, isobutyl (meth)acrylate, propyl (meth)acrylate, n-octyl (meth)acrylate, dodecyl (meth)acrylate, 2-ethylhexyl (meth)acrylate, stearyl (meth)acrylate, 2-chloroethyl (meth)acrylate, phenyl (meth)acrylate, and methyl α-chloroacrylate; (meth)acrylic acid derivatives such as acrylonitrile; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; and vinyl naphthalines. Among these, styrenes are preferable and styrene is more preferable. These monomers may be used in a combination of two or more.

Examples of the vinyl monomer having a nitrogen-containing polar functional group are N-vinyl compounds, amino (meth)acrylic monomers, methacrylonitrile, and (meth) acrylic amide. Specific examples of the N-vinyl compound are N-vinyl pyrrole, N-vinyl carbazole, N-vinyl indole, and N-vinyl pyrrolidone. Preferable examples of the amino (meth)acrylic monomer are the compounds represented by the formula below:

$$CH2=C(R^1)—(CO)—X—N(R^2)(R^3)$$

(in the formula, $R^1$ represents hydrogen or a methyl group; $R^2$ and $R^3$ respectively represent a hydrogen atom or an alkyl group of from 1 to 20 carbon atoms; X represents —O—, —O-Q-, or —NH; and Q represents an alkylene group of from 1 to 10 carbon atoms, a phenylene group, or a combination of these groups).

In the above-mentioned formula, specific examples of $R^2$ and $R^3$ are methyl group, ethyl group, n-propyl group, isopropyl group, n-butyl group, iso-butyl group, sec-butyl group, tert-butyl group, n-pentyl group, iso-pentyl group, tert-pentyl group, n-hexyl group, n-heptyl group, n-octyl group, 2-ethylhexyl group, n-nonyl group, n-decyl group, n-undecyl group, n-dodecyl group (lauryl group), n-tridecyl group, n-tetradecyl group, n-pentadecyl group, n-hexadecyl group, n-heptadecyl group, n-octadecyl group (stearyl group), n-nonadecyl group, and n-icosyl group.

In the above-mentioned formula, specific examples of Q are methylene group, 1,2-ethanediyl group, 1,1-ethylene group, propane-1,3-diyl group, propane-2,2-diyl group, propane-1,1-diyl group, propane-1,2-diyl group, butane-1,4-diyl group, pentane-1,5-diyl group, hexane-1,6-diyl group, heptane-1,7-diyl group, octane-1,8-diyl group, nonane-1,9-diyl group, decane-1,10-diyl group, p-phenylene group, m-phenylene group, o-phenylene group, and a divalent group without hydrogen at 4-site of phenyl group in a benzyl group.

Specific examples of the amino (meth)acrylic monomer represented by the above-mentioned formula are N,N-dimethylamino (meth)acrylate, N,N-dimethylaminomethyl (meth)acrylate, N,N-diethylaminomethyl (meth)acrylate, 2-(N,N-methylamino)ethyl (meth)acrylate, 2-(N,N-diethylamino)ethyl (meth)acrylate, 3-(N,N-dimethylamino)propyl (meth)acrylate, 4-(N,N-dimethylamino)butyl (meth)acrylate, p-N,N-dimethylaminophenyl (meth)acrylate, p-N,N-diethylaminophenyl (meth)acrylate, p-N,N-dipropylaminophenyl (meth)acrylate, p-N,N-di-n-butylaminophenyl (meth)acrylate, p-N-laurylaminophenyl (meth)acrylate, p-N-stearylaminophenyl (meth)acrylate, (p-N,N-dimethylaminophenyl)methyl (meth)acrylate, (p-N,N-diethylaminophenyl)methyl (meth)acrylate, (p-N,N-di-n-propylaminophenyl)methyl (meth)acrylate, (p-N,N-di-n-butylaminophenyl)methylbenzyl (meth)acrylate, (p-N-laurylaminophenyl)methyl (meth)acrylate, (p-N-stearylaminophenyl)methyl (meth)acrylate, N,N-dimethylaminoethyl (meth)acrylamide, N,N-diethylaminoethyl (meth)acrylamide, 3-(N,N-dimethylamino)propyl (meth)acrylamide, 3-(N,N-diethylamino)propyl (meth)acrylamide, p-N,N-dimethylaminophenyl (meth)acrylamide, p-N,N-diethylaminophenyl (meth)acrylamide, p-N,N-di-n-propylaminophenyl (meth)acrylamide, p-N,N-di-n-butylaminophenyl (meth)acrylamide, p-N-laurylaminophenyl (meth)acrylamide, p-N-stearylaminophenyl (meth)acrylamide, (p-N,N-dimethylaminophenyl)methyl (meth)acrylamide, (p-N,N-diethylaminophenyl)methyl (meth)acrylamide, (p-N,N-di-n-propylaminophenyl)methyl (meth)acrylamide, (p-N,N-di-n-butylaminophenyl)methyl (meth)acrylamide, (p-N-laurylaminophenyl)methyl (meth)acrylamide, and (p-N-stearylaminophenyl)methyl (meth)acrylamide.

The vinyl monomer having a fluorine-substituted hydrocarbon group is not particularly limited as long as it is used for producing a fluorine-containing resin. Specific examples of the vinyl monomer having a fluorine-substituted hydrocarbon group are fluoroalkyl (meth)acrylates such as 2,2,2-trifluoroethyl acrylate, 2,2,3,3-tetrafluoropropyl acrylate, 2,2,3,3,4,4,5,5-octafluoroamyl acrylate, and 1H,1H,2H,2H-heptadecafluorodecyl acrylate; and fluoroolefins such as trifluorochloroethylene, vinylidene fluoride, trifluoroethylene, tetrafluoroethylene, trifluoropropylene, and hexafluoropropene. Among these, fluoroalkyl (meth)acrylates are preferable.

Examples of the vinyl-based monomer having a sulfo group as a negative chargeable functional group that is used as the monomer for the negative chargeable charge-control resin may include 2-acrylamide-2-methylpropanesulfonic acid; sodium styrenesulfonate; and sulfoalkyl (meth)acrylate-based monomers such as sulfoethyl acrylate, sulfoethyl methacrylate and sodium sulfoethyl methacrylate. Of these, 2-acrylamide-2-methylpropanesulfonic acid is preferable.

The addition polymerization process of the monomer having an unsaturated bond may be optionally selected from the processes of solution polymerization, bulk polymerization, emulsion polymerization, and suspension polymerization. Among these production processes, an emulsion polymerization process is preferable since resin fine particles with a uniform particle diameter may be easily obtained.

In the polymerization of the vinyl monomers described above, conventional polymerization initiators such as potassium persulfate, acetyl peroxide, decanoyl peroxide, lauroyl peroxide, benzoyl peroxide, azobisisobutyronitrile, 2,2'-azobis-2,4-dimethyl valeronitrile, and 2,2'-azobis-4-methoxy-2,4-dimethyl valeronitrile may be used. The amount of these polymerization initiators used is preferably from 0.1% to 15% by mass based on the total mass of monomers.

In the case where the monomer having an unsaturated bond is subjected to addition polymerization by using an aqueous medium, as in emulsification polymerization or suspension polymerization, a surfactant may be used. The surfactant may be suitably selected from the group consisting of anionic surfactants, cationic surfactants and nonionic surfactants. Examples of anionic surfactants may include sulfate ester salt-type surfactants, sulfonate salt-type surfactants, phosphate ester salt-type surfactants and soaps. Examples of cationic surfactants may include amine salt-type surfactants and quaternary ammonium salt-type surfactants. Examples of nonionic surfactants may include polyethylene glycol-type surfactants, alkylphenol ethylene oxide adduct-type surfactants, and polyhydric alcohol-type surfactants that are derivatives of polyhydric alcohols such as glycerin, sorbitol and sorbitan. Among these surfactants, it is preferable to use at least one of the anionic surfactants and nonionic surfactants. These surfactants may be used alone or in a combination of two or more.

In the case where the resin fine particles are produced by an emulsification polymerization process, the resin fine particles can be produced by a soap-free emulsification polymerization process in which an emulsifier (surfactant) is not used.

In the soap-free emulsion polymerization process, a radical of the initiator occurring in an aqueous phase induces the polymerization of a monomer slightly dissolved in the aqueous phase. As the polymerization progresses, particle cores of insolubilized resin fine particles are formed. The use of the soap-free emulsion polymerization process may result in resin fine particles with a narrow distribution of particle diameters and thus the average particle diameter of the resin fine particles may be easily controlled within a range from 0.03 μm to 1 μm. Therefore, the use of the soap-free emulsion polymerization process may result in the resin fine particles with a uniform particle diameter.

In the case where the shell layers are formed by using resin fine particles having homogenous particle diameters obtained by the soap-free emulsification polymerization process, the unevenness of adhesion of the resin fine particles to the toner core particles can be decreased, and thus homogeneous shell layers having even thicknesses can be formed.

The resin fine particles produced by the soap-free emulsion polymerization process are formed using no emulsifying agent (surfactant).

Therefore, when the shell layers are formed by using the resin fine particles obtained by the soap-free emulsification polymerization process, toner particles that resist the adverse effects of humidity can be obtained.

In the case where the charge-control resin is a copolymer of a monomer having a chargeable functional group that imparts chargeability to the resin and an unsaturated bond and a monomer having no chargeable functional group but having an unsaturated bond, the molar ratio of the constitutional unit derived from the monomer having a chargeable functional group and an unsaturated bond to the all of the constitutional units in the charge-control resin is preferably 1 mol % or more and 10 mol % or less, more preferably 3 mol % or more and 7 mol % or less.

The content of the charge-control resin in the resin that constitutes the resin fine particles is preferably 80% by mass or more, more preferably 90% by mass or more, most preferably 100% by mass with respect to the total mass of the resin fine particles. In the case where the resin that constitutes the resin fine particles is a mixture of the charge-control resin and the resin having no chargeable functional group, a polymer of one or more monomer(s) selected from the above-mentioned vinyl-based monomers having no chargeable functional group may be used as the resin having no chargeable functional group. Where necessary, the resin fine particles may be prepared by using a resin containing the above-mentioned colorant.

The mixture of the charge-control resin and the resin having no chargeable functional group can be prepared by a method in which two or more resins are melt-kneaded by using a melt kneader such as a biaxial extruder, or by a method in which two or more resins are dissolved in an organic solvent to give a resin solution, and the organic solvent is removed from the resin solution.

The shell layers may also be formed by using resin fine particles formed of a resin containing the charge-control resin and resin fine particles formed of a resin having no chargeable functional group in combination. In this case, the proportion of the mass of the resin fine particles formed of a resin containing the charge-control resin with respect to the total mass of the resin fine particles used to form the shell layers is preferably 80% by mass or more, more preferably 90% by mass or more. In this case, resin fine particles formed of a polymer of one or more monomer(s) selected from the above-mentioned vinyl-based monomers having no chargeable functional group may be used as the resin fine particles formed of the resin having no chargeable functional group.

The resin fine particles may contain components such as a colorant and a charge control agent as described above as required. In cases where the resin fine particles contain a sufficient amount of a charge control agent, the toner core particles may include no charge control agent.

The glass transition point of the resin constituting the resin fine particles is preferably from 45° C. to 90° C. and more preferably from 50° C. to 80° C.

The softening point of the resin constituting the resin fine particles is preferably from 100° C. to 250° C. and more preferably from 110° C. to 240° C. The softening point of the resin constituting the resin fine particles is preferably higher than the softening point of the binder resin in the toner core particles and more preferably 10° C. to 140° C. higher than the softening point of the binder resin. When the shell layer is formed using the resin fine particles consisting of the resin with the softening point within this range, the parts of the resin fine particles contacting the toner core particles are unlikely to deform when the resin fine particles are embedded into the toner core particles. Consequently, convex parts derived from the shape of the resin fine particles prior to forming a shell layer are likely to be formed at an inner surface of the shell layer.

The mass average molecular mass (Mw) of the resin constituting the resin fine particles is preferably from 20,000 to 1,500,000. The mass average molecular mass (Mw) of the resin constituting the resin fine particles can be determined using gel permeation chromatography (GPC) from a molecular mass distribution on a mass basis.

The average particle diameter of the resin fine particles is preferably from 30 nm to 1000 nm, more preferably from 40 nm to 700 nm, particularly preferably from 45 nm to 500 nm, and most preferably from 45 nm to 300 nm. When producing a toner using the resin fine particles with such a particle diameter, the surface of the toner core particles may be easily coated uniformly with the resin fine particles aligned into a monolayer and thus a shell layer with an intended structure may be easily formed.

In cases of producing a toner using the resin fine particles with an excessively small average particle diameter, a shell layer with a preferable thickness may not be formed on the surface of the toner core particles and thus a toner with excellent heat-resistant storage stability may not be obtained. In cases of producing a toner using the resin fine particles with an excessively large average particle diameter, it is difficult to attach the resin fine particles uniformly onto the surface of the toner core particles. Therefore, it is difficult to form the shell layer with a predetermined structure and thus a toner with excellent heat-resistant storage stability is unlikely to be obtained.

The average particle diameter of the resin fine particles can be adjusted by controlling polymerization conditions and using conventional processes such as pulverizing processes and classifying processes. The average particle diameter of the resin fine particles can be computed as a number average particle diameter by measuring a particle diameter for at least 50 resin fine particles from an electron microscope photograph taken using a field emission scanning electron microscope (e.g., JSM-7600F, by JEOL Ltd.).

The amount of the resin fine particles used is preferably from 1 to 20 parts by mass and more preferably from 3 to 15 parts by mass based on 100 parts by mass of the toner core particles.

If the used amount of the resin fine particles in the production of the toner particles is excessively small, the entire surfaces of the toner core particles cannot be coated with the resin fine particles. In the case where the entire surfaces of the toner core particles cannot be coated with the resin fine particles, the toner particles may agglomerate during storage at a high temperature, and thus the heat-resistant storage stability of the heat-resistant storage toner may decrease. In cases where the amount of the resin fine particles used is excessively large when producing the toner particles in the toner, the shell layers may become thick. In this case, the toner with excellent fixability may not be obtained.

External Additive

The toner core particles coated with the shell layer may be treated using an external additive as required. Hereinafter, the particles treated using the external additive is also described as "toner base particles".

The external additive may be exemplified by silica and metal oxides such as alumina, titanium oxide, magnesium oxide, zinc oxide, strontium titanate, and barium titanate. These external additives may be used in a combination of two or more.

The particle diameter of the external additive is preferably from 0.01 μm to 1.0 μm.

The amount of the external additive used is preferably from 0.1% to 10% by mass and more preferably from 0.2% to 5% by mass based on the total mass of the toner base particles produced by forming the shell layer on the surface of the toner core particles. Toner particles treated with an excessively small amount of the external additive exhibits low hydrophobicity. Such a toner which includes toner particles with low hydrophobicity is likely to be affected by water molecules in air under high temperature and high humidity environments. In cases of using a toner, which includes toner particles treated with an excessively small amount of the external additive, problems such as decrease of image density of resulting images due to extreme lowering of the charged amount of the toner and lowering of flowability of the toner tend to occur. In cases of using a toner, which includes toner particles treated with an excessively large amount of the external additive, decrease of image density of resulting images may be caused due to an excessive charge up of the toner particles.

Method of Producing Toner Particles

The method of producing the toner particles in the toner of the present disclosure is not particularly limited as long as toner particles where toner core particles are coated with a shell layer of a predetermined structure can be produced. If desired, external treatment to attach an external additive to a surface of toner base particles may be applied using the toner core particles coated with a shell layer as toner base particles. A preferable method of producing the toner particles in the toner of the present disclosure is explained with respect to a method of producing toner core particles, a method of forming a shell layer, and an external addition treatment method in order below.

Method of Producing Toner Core Particles

The method of producing toner core particles is not particularly limited as long as optional components such as a colorant, a release agent, and a charge control agent besides a magnetic powder can be appropriately dispersed in a binder resin. A specific example of a desirable method of producing the toner core particles may be such that a binder resin, a magnetic powder, and components including a colorant, a release agent, and a charge control agent are mixed using a mixer, then the binder resin and the components to be compounded with the binder resin are melted and kneaded using a kneading machine such as a single or twin screw extruder, and the kneaded material after cooling is pulverized and classified. Typically, the average particle diameter of the toner core particles is preferably from 5 μm to 10 μm.

Method of Forming Shell Layer

The shell layer is formed using spherical resin fine particles. More specifically, the shell layer is formed by a method including:

I) a step of making spherical resin fine particles adhere to the surface of the toner core particles so as to not overlap thereon in a direction perpendicular to the surfaces of the toner core particles and forming layers of the resin fine particles that covers the entire surfaces of the toner core particles, and II) a step of smoothening the outer surfaces of the layers of the resin fine particles to thereby form shell layers by applying an external force to the outer surfaces of the layers of the resin fine particles and deforming the resin fine particles in the layers of the resin fine particles.

The method of forming the shell layer using the resin fine particles is preferably a method of using a mixing device capable of mixing the toner core particles and the resin fine particles under a dry condition. A specific method thereof may be exemplified by the method that uses a mixing device capable of applying a mechanical external force to the toner core particles, onto the surfaces of which the resin fine particles have adhered, while making the resin fine particles adhere to the surfaces of the toner core particles and thereby form the shell layers on the surfaces of the toner core particles. The mechanical external force may be exemplified by a shear force that is applied to the toner core particles and that is derived from a shear between the toner core particles themselves or a shear occurring between the toner core particles and an inner wall of the mixing device, a rotor, or a stator; and an impulsive force that is applied to the toner core particles and that is derived from collision between the toner core particles themselves or collision between the toner core particles and an inner wall of the mixing device, when the toner core particles rapidly move within a narrow and small space in the mixing device.

A more specific method is explained. Initially, the toner core particles and the resin fine particles are mixed in a mixing device, thereby making the resin fine particles uniformly adhere to the surfaces of the toner core particles so as to not overlap in a direction perpendicular to the surfaces of the toner core particles. When contacting the toner core particle with a large particle diameter and the resin fine particle with a small particle diameter, the surface of the toner core particle microscopically assume a planar surface and the surface of the resin fine particles cause a surface-surface contact. Therefore, the resin fine particles tend to easily adhere to the toner core particle. On the other hand, when contacting the resin fine particles themselves, the contact occurs between curved surfaces of two resin fine particles to thereby cause a point-point contact. Therefore, in the step of making the resin fine particles adhere to the toner core particles, even when a resin fine particle is further adhering to the resin fine particle which has adhered to the surface of the toner core particle, the resin fine particle adhering to the resin fine particle is easily detached from the resin fine particle by a mechanical external force by the mixing device which is applied to the toner core particle to which the resin fine particle has adhered. For this reason, in accordance with the method explained below, the toner core particles are coated with the resin fine particles in a way that the resin fine particles do not overlap in a direction perpendicular to the surfaces of the toner core particles.

When making the resin fine particles adhere to the toner core particles, the above-mentioned mechanical external force is applied to the layers of the resin fine particles at the surfaces of the toner core particles. As a result, the resin fine particles deform while being embedded into the toner core particles by action of the mechanical external force, and thus the outer surfaces of the layers of the resin fine particles covering the entire surfaces of the toner core particles are smoothened and the layers of the resin fine particles transform into shell layers. When the shell layers are formed, whereby the smoothening progresses at the outer surfaces of the shell layers, boundary surfaces between the resin fine particles remain inside the shell layers. Therefore, cracks in a direction approximately perpendicular to the surfaces of the toner core particles are formed inside the shell layers formed using the resin fine particles.

In this stage, when the material of the toner core particles has a hardness equivalent or somewhat higher than that of the resin fine particles forming the shell layer, the inner surface of the shell layer (surface of the side of the toner core particles) may be smoothened. On the other hand, when the material of the toner core particles is softer than the material of the resin fine particles forming the shell layer, the parts of the resin fine particles contacting the toner core particles are resistant to deforming when the resin fine particles are embedded into the toner core particles, therefore, convex parts derived from the shape of the resin fine particles prior to transforming into the shell layer are likely to be formed at the inner surface of the shell layer. In this case, the convex part is formed between two cracks in the shell layer.

In the above-mentioned method, when the mechanical external force is weak, the resin fine particles do not deform to an intended level and thus the shell layer with a predetermined shape may not be formed. Although the condition to form the shell layer with a predetermined shape depends on the type of devices used for forming the shell layer, an appropriate condition for forming a predetermined shell layer can be determined with respect to various devices by confirming the structure of shell layers of toner particles obtained through various conditions while changing operation conditions in a stepwise manner such that the mechanical external force applying to toner core particles coated with resin fine particles becomes larger. However, when the mechanical external force is too large, problems may occur such that the resin fine particles excessively deform and thus cracks in a direction approximately perpendicular to the surface of the toner core particles are not formed inside the shell layer or the mechanical external force is converted into heat and thus the toner core particles or the resin fine particles melt.

The devices, allowing to coat the toner core particles using the resin fine particles and also to apply a mechanical external force to the toner core particles coated with the resin fine particles, may be exemplified by Hybridizer NHS-1 (by Nara Machinery Co.), Cosmos System (by Kawasaki Heavy Industries, Ltd.), Henschel mixer (by Nippon Coke & Engineering Co.), Multi-Purpose mixer (by Nippon Coke & Engineering Co.), COMPOSI (by Nippon Coke & Engineering Co.), Mechanofusion system (by Hosokawa Micron Co.), Mechanomill (by Okada Seiko Co.), and Nobilta (by Hosokawa Micron Co.).

In the toner of the present disclosure, the toner core particles are coated with shell layers so that the magnetic powder will not be observed on the surfaces of the shell layers of the toner particles in the case where the surfaces of the toner particles are observed using a scanning electron microscope. In the case where the magnetic powder is observed on the surfaces of the shell layers, it is possible to prevent the magnetic powder from being observed on the surfaces of the shell layers by a method of decreasing the particle diameter of the magnetic powder, a method of decreasing the used amount of the magnetic powder, a method of increasing the particle diameter of the resin fine particles used in the formation of the shell layer, or a method including these methods in combination.

External Addition Treatment Method

The method of treating the toner base particles using an external additive is not particularly limited and the toner base particles can be treated in accordance with methods known heretofore. Specifically, treatment conditions are controlled such that particles of the external additive are not embedded into toner base particles, and the treatment using the external additive is performed by a mixer such as Henschel mixer and Nauter mixer.

The magnetic toner for electrostatic latent image development of the present disclosure explained above has excellent fixability and heat-resistant storage stability, and can charge toner particles at a desired charge amount in the case where an image is formed in an environment of ordinary temperature and ordinary humidity or an environment of high temperature and high humidity over a long time period. Therefore, an image having a desired image density can be formed.

Accordingly, the magnetic toner for electrostatic latent image development of the present disclosure may be favorably used for various image forming apparatuses.

EXAMPLES

The present disclosure is explained more specifically with reference to examples below. In addition, the present disclosure is not limited to the examples.

Although cases where the toner contains only toner particles are exemplified as the toners of the Examples and Comparative Examples of the present disclosure, the toner may contain other constitutional components.

Production Example 1

Production of Polyester Resin 1960 g of propylene oxide adduct of bisphenol A, 780 g of ethylene oxide adduct of bisphenol A, 257 g of dodecenyl succinic anhydride, 770 g of terephthalic acid, and 4 g of dibutyltin oxide were introduced into a reaction container. Next, the atmosphere in the reaction container was changed to nitrogen, and the temperature in the reaction container was raised to 235° C. while stirring. Then, after allowing to react at the same temperature for 8 hours, the pressure inside the reaction container was reduced to 8.3 kPa and the reaction was allowed to proceed for 1 hour. Thereafter, the reaction mixture was cooled to 180° C., and trimellitic anhydride was added to the reaction container so that an acid value of the reaction mixture became an intended value. Then, the temperature of the reaction mixture was raised to 210° C. at a rate of 10° C./hr and reaction was allowed to proceed at the same temperature. After completing the reaction, the content in the reaction container was taken out and cooled, thereby obtaining a polyester resin.

Production Example 2

(Production of Magnetic Powders A to D)

Magnetic powders A to D described in Table 1 were each prepared by the following method.

First, 26.7 L of an aqueous solution of ferrous sulfate salt containing 1.5 mol/L of $Fe^{2+}$, and a 3.4 mol/L aqueous solution of sodium hydroxide in an amount described in Table 1 were added to a reaction container and mixed. The pH of the mixed liquid was adjusted to 10.5 by using sulfuric acid or sodium hydroxide, and the mixture in the reaction container was heated to 90° C. to form a suspension liquid of ferrous sulfate salt containing ferrous hydroxide ion colloid.

Subsequently, air was blown into the suspension liquid at 100 L/min for 80 minutes at the same temperature to thereby initiate an oxidation reaction. After the oxidation reaction of the ferrous salt had progressed to a reaction rate of 60%, the pH of the suspension liquid was adjusted to 6.5 by using an aqueous solution of sulfuric acid. After the pH was adjusted, air was blown into the suspension liquid again at 100 L/min at 90° C. for 50 minutes to form magnetite particles in the suspension liquid. Thereafter the pH of the suspension liquid was adjusted to the value described in Table 1 by using sulfuric acid or sodium hydroxide. Subsequently, air was blown into the suspension liquid again at 100 L/min at 90° C. for 20 minutes to give slurry containing magnetite particles.

The magnetite particles were separated by filtration from the slurry containing the magnetite particles by a conventional method. The magnetite particles separated by filtration were washed and dried, and pulverized to thereby give magnetic powders A to D having the shape and average particle diameter described in Table 1.

The shapes of magnetic powders A to D were each confirmed on a picture photographed by using a scanning electron microscope (JSM-7600 (manufactured by JEOL Ltd.)) (magnification range: 10,000× to 50,000×). The shapes of magnetic powders A, C and D were octahedra that were convex polyhedra surrounded by eight triangles. Magnetic powder B had a spherical shape.

Method for Measuring Average Particle Diameter

By using a magnetic powder dispersion liquid formed by dispersing the magnetic powder in water as a sample, the average particle diameter of the magnetic powder was measured with a particle-size distribution measurement apparatus (LA-700 (manufactured by Horiba Ltd.)).

TABLE 1

| | Magnetic powder | | | |
|---|---|---|---|---|
| | A | B | C | D |
| Amount of aqueous solution of sodium hydroxide (L) | 18.6 | 14.0 | 28.0 | 30.6 |
| pH | 10.5 | 8.5 | 11.5 | 10.5 |
| Average particle diameter (μm) | 0.20 | 0.05 | 1.02 | 1.10 |
| Shape | Octahedral | Spherical | Octahedral | Octahedral |

Production Example 3

Production of Resin Fine Particles A 450 mL of distilled water and 0.52 g of dodecyl ammonium chloride were charged in a 1000-mL reaction container equipped with a stirring apparatus, a thermometer, a cooling tube and a nitrogen introduction apparatus. The temperature in the reaction container was raised to 80° C. while the contents of the reaction container were stirred under a nitrogen atmosphere. After the temperature was raised, 120 g of an aqueous solution of potassium persulfate (polymerization initiator) having a concentration of 1% by mass and 200 g of ion-exchanged water were added to the reaction container. Subsequently, a mixture composed of 15 g of butyl acrylate, 165 g of methyl methacrylate and 3.6 g of n-octylmercaptan (a chain-transfer agent) was added dropwise to the reaction container over 1.5 hours, and polymerization was conducted over an additional 2 hours to give an aqueous dispersion liquid of the resin fine particles. The obtained aqueous dispersion liquid of the resin fine particles was dried by freeze drying to give resin fine particles. The resin fine particles had a number-average particle diameter of 0.10 μm.

In order to measure the number-average particle diameter of the resin fine particles, a picture of the resin fine particles at 100,000× magnification was photographed by using a field emission scanning electron microscope (JSM-6700F (manufactured by JEOL. Ltd.)). Where necessary, the electron micrograph was further enlarged, and the particle diameters of 50 or more resin fine particles were measured by using a measurement device such as a ruler and caliper. The number-average particle diameter of the resin fine particles was calculated from the obtained measurement values.

Production of Resin Fine Particles B

A flask with a volume of 2,000 mL equipped with a stirring apparatus, a thermometer, a cooling tube and a nitrogen introduction tube was used as a reaction container. 180 g of isobutanol was put into the reaction container as a solvent, and 16 g of diethylaminoethyl methacrylate and 16 g of methyl p-toluenesulfonate were charged into the reaction container. The reaction container was put on a mantle heater, and nitrogen gas was introduced from the nitrogen introduction tube into the reaction container to form an inert atmosphere in the reaction container. Subsequently, the internal temperature of the reaction container was raised to 80° C. while the mixture in the flask was stirred, and the stirring was continued at the same temperature for 1 hour to thereby carry out a quaternizing reaction.

After the quaternizing reaction, 214 g of styrene, 72 g of butyl acrylate, and 12 g of t-butylperoxy-2-ethylhexanoate (manufactured by Arkema Yoshitomi Ltd.), which is a peroxide-based initiator, were added to the reaction container. The internal temperature of the reaction container was increased to 95° C. (polymerization temperature), and the contents of the reaction container were stirred for 3 hours. Subsequently, 6 g of t-butyl peroxy-2-ethylhexanoate was further added to the reaction container. Subsequently, the contents of the reaction container were stirred at 95° C. for 3 hours to complete the polymerization reaction, to thereby give a dispersion liquid of resin fine particles. The resultant dispersion liquid of resin fine particles was dried by freeze drying to give powdery resin fine particles B. The resin fine particles B had a number-average particle diameter of 0.10 μm.

Production of Resin Fine Particles C

A flask with a volume of 3,000 mL equipped with a stirring apparatus, a thermometer, a cooling tube and a nitrogen introduction tube was used as a reaction container. 1,000 g of pure water was put in a reaction container, and 8 g of a monoalkyl succinate sulfonate disodium salt as an emulsifier and 2 g of polyoxyethylene polycyclic phenyl ether sulfate ester salt were charged into the reaction container. The reaction container was put on a mantle heater, and nitrogen gas was introduced from the nitrogen introduction tube into the reaction container for 30 minutes to form an inert atmosphere in the reaction container. Subsequently, 2 g of potassium peroxodisulfate (KPS) was added to the reaction container as a polymerization initiator and dissolved while the contents of the reaction container were stirred.

Subsequently, the internal temperature of the reaction container was raised to 70° C. while the mixture was stirred, and a monomer mixture of 280 g of styrene and 80 g of acrylic acid-2-ethylhexyl (2-EHA), and an aqueous solution in which 40 g of 2-acrylamide-2-methylpropanesulfonic acid (AAPS)

was dissolved in 600 g of pure water, were respectively added dropwise to the reaction container over 3 hours. Subsequently, the internal temperature of the reaction container was raised to 80° C. (the polymerization temperature), and the contents of the reaction container were stirred for 3 hours. Subsequently, 0.3 g of KPS was further added to the reaction container, the internal temperature of the reaction container was raised to 85° C., and stirring was performed for 2 hours to thereby complete the polymerization reaction. The resulted aqueous dispersion liquid of resin fine particles was dried by freeze drying to thereby give resin fine particles C. The resin fine particles C had a number-average particle diameter ($D_{50}$) of 0.10 μm.

Examples 1 to 3, Comparative Examples 1 and 3

Method of Producing Toner Core Particles 51 parts by mass of the binder resin (the polyester resin obtained through Production Example 1), 45 parts by mass of a magnetic powder of the kind described in Table 2, 3 parts by mass of a release agent (polypropylene wax 660P (manufactured by Sanyo Chemical Industries, Ltd.)) and 1 part by mass of a charge-control agent (P-51 (manufactured by Orient Chemical Industries Co., Ltd.)) were mixed in a mixer to give a mixture.

Next, the mixture was melted and kneaded using a twin screw extruder, thereby obtaining a kneaded material. The kneaded material was coarsely pulverized using a pulverizing device (Rotoplex, by Toakikai Co.), thereby obtaining a coarsely pulverized material. The coarsely pulverized material was finely pulverized using a mechanical pulverizing device (Turbo mill, by Turbo Industries, Co.), thereby obtaining a finely pulverized material. The finely pulverized material was classified using a classifier (Elbow Jet, by Nittetsu Mining Co.), thereby obtaining toner core particles with a volume average particle diameter ($D_{50}$) of 7.0 μm. The volume average particle diameter of the toner core particles was measured using a Coulter Counter Multisizer 3 (by Beckman Coulter Inc.).

(Preparation of Toner Base Particles)

Using 10 g of the resin fine particles A obtained through Production Example 3 and 100 g of the toner core particles obtained through Production Example 2, the toner core particles were coated with the resin fine particles A and shell layers were formed on the surfaces of the toner core particles. A powder treatment device (Multi-Purpose Mixer Model MP, by Nippon Coke & Engineering Co.) was used for the shell-forming treatment.

Specifically, the toner core particles and resin fine particles A were put into a treatment bath of a powder treatment device and treated at the rotation speed and for the treatment time described in Table 2 to give toner base particles.

External Addition Treatment

The resulting toner base particles were treated with titanium oxide (EC-100, by Titan Kogyo, Ltd.) of 2.0% by mass and hydrophobic silica (RA-200H, by Japan Aerosil Co.) of 1.0% by mass based on the mass of the toner base particles. The toner base particles, the titanium oxide, and the hydrophobic silica were stirred and mixed at a rotational circumferential velocity of 30 m/sec for 5 minutes using a Henschel mixer (by Nippon Coke & Engineering Co.), thereby obtaining toner.

Comparative Example 2

10 g of resin fine particles A obtained through Production Example 3 was used for 100 g of toner core particles obtained through a similar manner to Example 1 to coat the toner core particles with shell layers to thereby form shell layers on the surfaces of the toner core particles.

A surface modification device (device for coating fine particles, Model SFP-01, by Powrex Co.) was used for forming the shell layer. Specifically, a toner was prepared by the method below. Initially, the toner core particles were circulated at a charge gas temperature of 80° C. in a fluid bed of the surface modification device. 300 g of an aqueous dispersion of the resin fine particles A obtained through Production Example 3, the concentration of which had been adjusted to include 10 g of the resin fine particles A, was sprayed into the fluid bed of the surface modification device at a spray speed of 5 g/min for 60 minutes, thereby obtaining toner base particles. The resulting toner base particles were subjected to externally addition treated similarly to Example 1, thereby obtaining a toner of Comparative Example 2.

Confirmation of Structure of Shell Layer

According to the following method, the surfaces of the toner particles included in the toners of Examples 1 to 3 and Comparative Examples 1 to 3 were observed using a scanning electron microscope (SEM) to thereby confirm the state of the surfaces of the shell layers coating the toner core particles, and the presence or absence of exposure of the magnetic powder on the outer surfaces of the shell layers.

Figure 2:
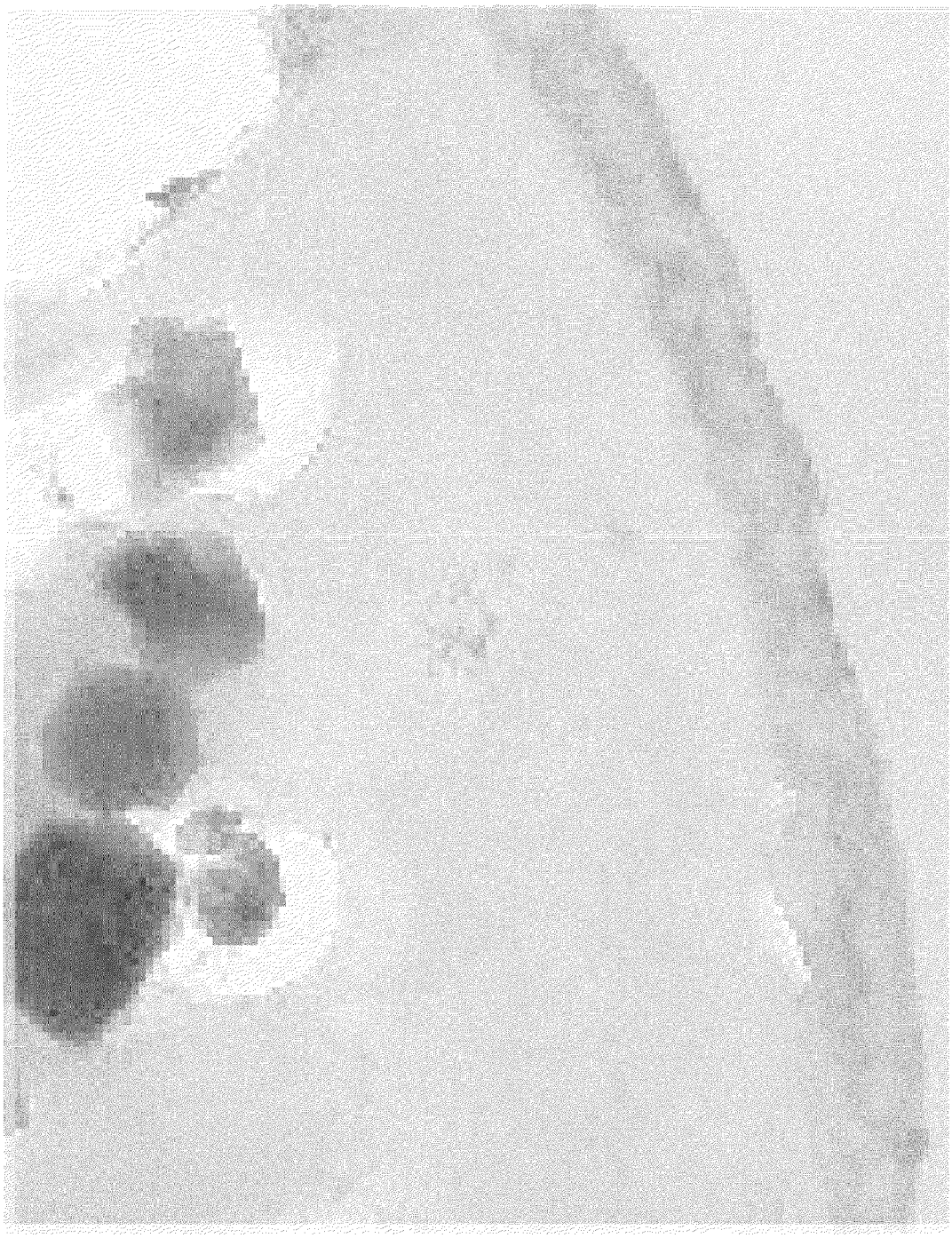
FIG. 2 is a transmission electron microscope photograph showing a cross-section of the toner particle in the toner of Example 1.
Figure 3:
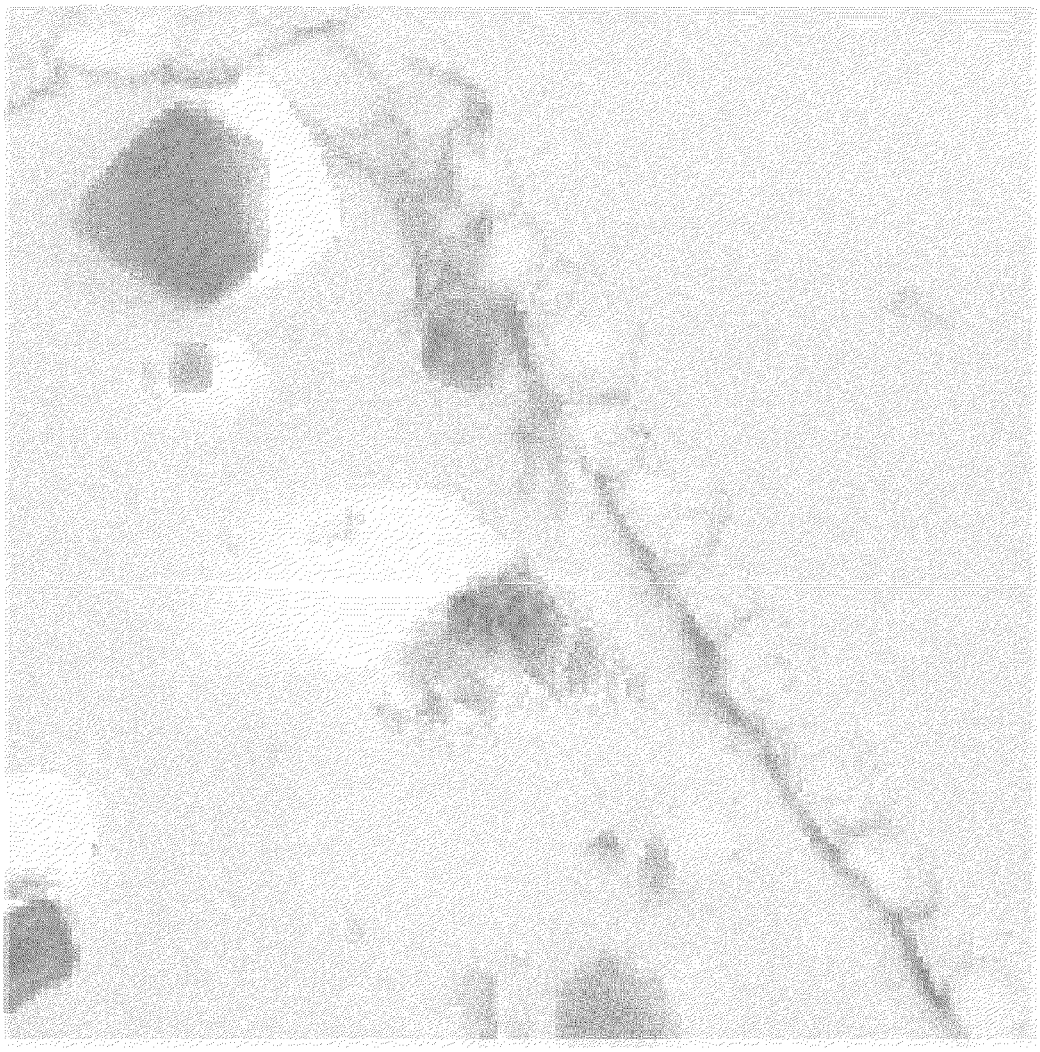
FIG. 3 is a transmission electron microscope photograph showing a cross-section of the toner particle in the toner of Comparative Example 1.
Figure 4:
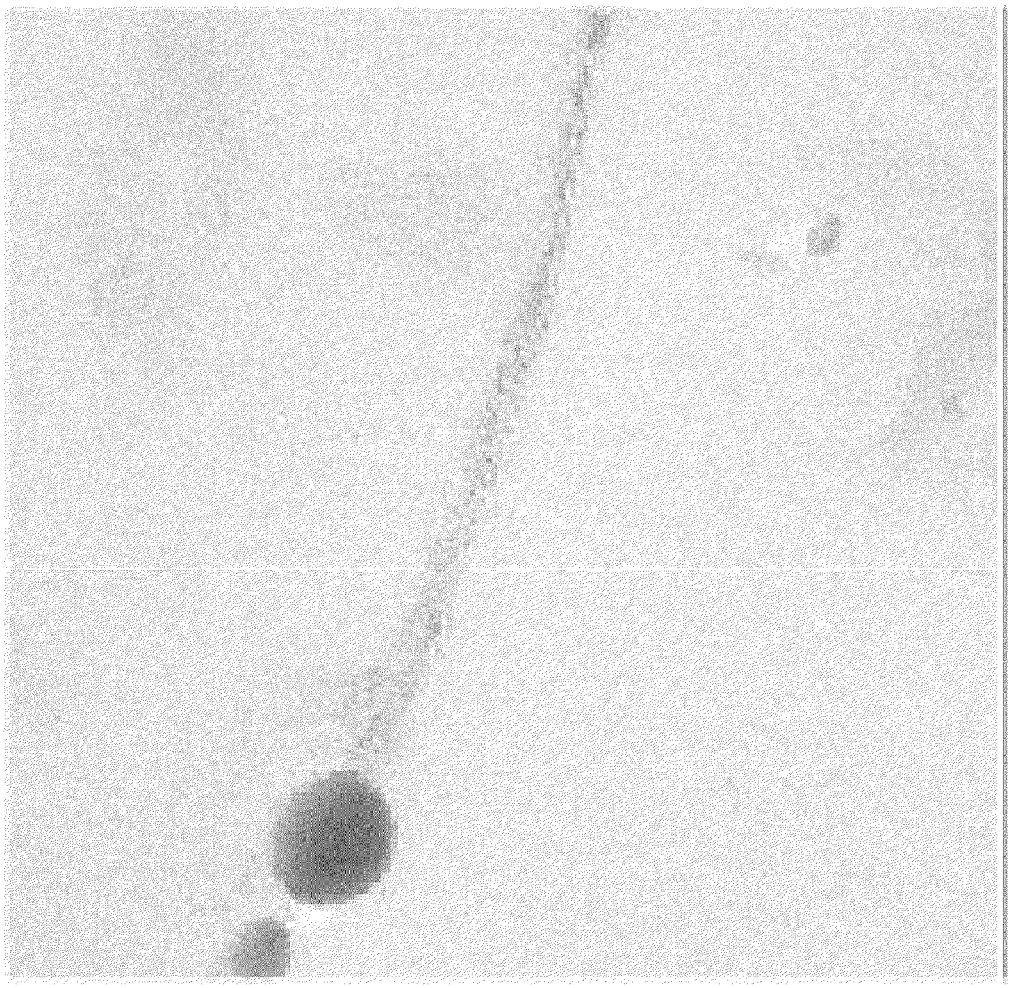
FIG. 4 is a transmission electron microscope photograph showing a cross-section of the toner particle in the toner of Comparative Example 2.
Figure 5:
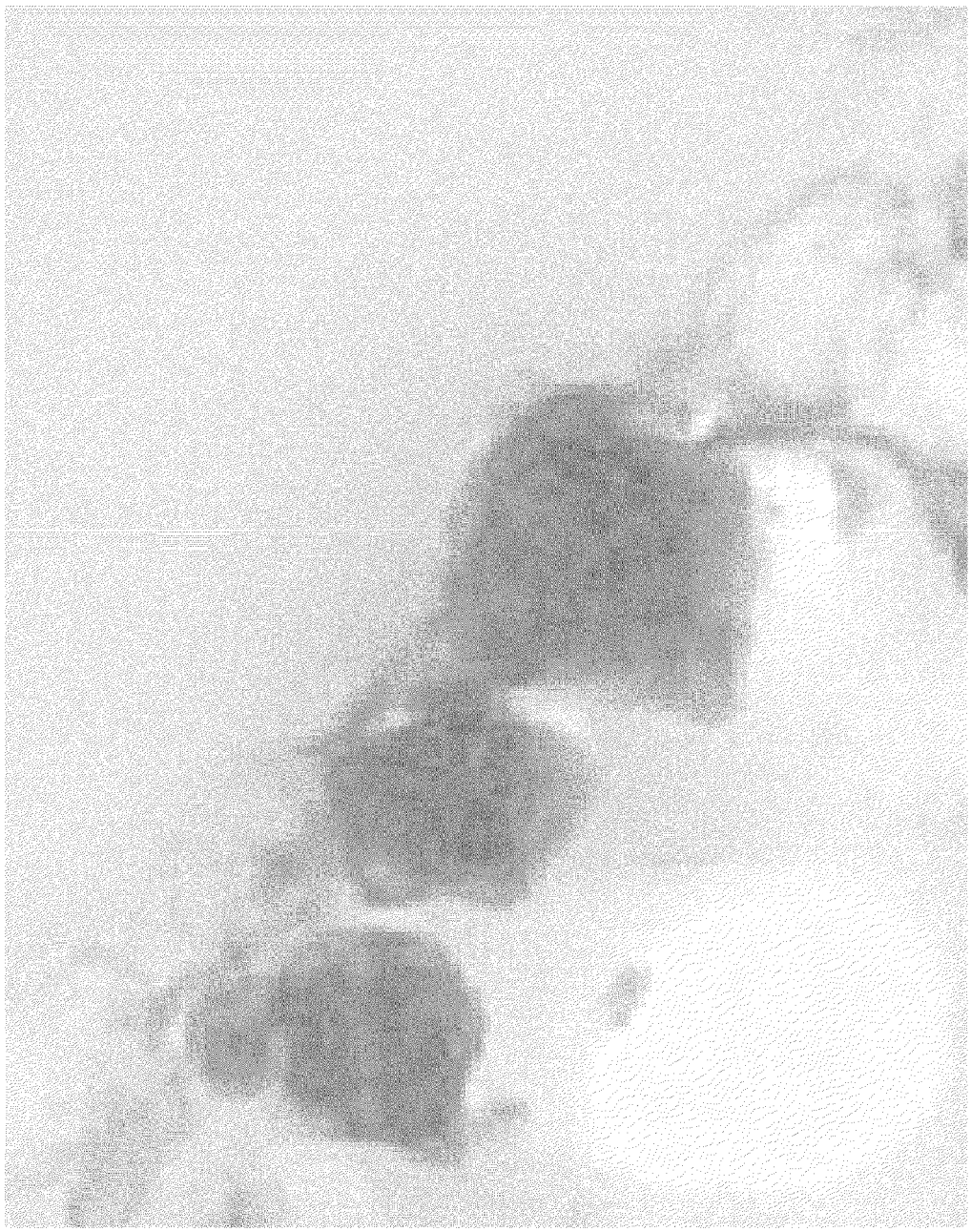
FIG. 5 is a transmission electron microscope photograph showing a cross-section of the toner particle in the toner of Comparative Example 3.

In accordance with the method below, photographs of cross-sections of the toner particles in the toners of Examples 1 to 3 and Comparative Examples 1 to 3 were taken using a transmission electron microscope (TEM). Using the resulting TEM photographs, surface conditions of shell layers, conditions inside shell layers, and shapes of inner surfaces of shell layers were confirmed. FIG. 2 shows a TEM photograph of a cross-section of the toner particle in the toner of Example 1, FIG. 3 shows a TEM photograph of a cross-section of the toner particle in the toner of Comparative Example 1, FIG. 4 shows a TEM photograph of a cross-section of the toner particle in the toner of Comparative Example 2, and FIG. 5 shows a TEM photograph of a cross-section of the toner particle in the toner of Comparative Example 3.

Method of Observing Surfaces of Toner Particles

Surfaces of toner particles were observed using a scanning electron microscope (JSM-6700F, by JEOL Ltd.) at a magnification of 10,000 times.

Method for Confirming Whether or not Magnetic Powder was Exposed

The surfaces of at least 50 or more toner particles were observed by using an EDX (JSM-7600FA (manufactured by JEOL Ltd.)) attached to a scanning electron in a visual field at 10,000× microscope magnification, and the elements were mapped by using an x-ray spectrometer. The surfaces of the 50 or more toner particles were analyzed by obtaining element-mapped images.

Method of Photographing Cross-Sections of Toner Particles

A sample where toner particles in a toner were enclosed and embedded in a resin was prepared. Using a microtome (EM UC6, by Leica Co.), a thin-piece sample of 200 nm thick for observing cross-sections of the toner particles was prepared from the resulting sample. The resulting thin-piece sample was observed using a transmission electron microscope (TEM, JSM-6700F, by JEOL Ltd.) at a magnification of 50,000 times and an image of an optional cross-section of the toner particles were photographed.

In regards to the toner particles in the toners of Example 1 to 3 and Comparative Examples 3, the structures derived from spherical resin fine particles could not be observed at the surfaces of shell layers with respect to the toner particles having a particle diameter from 6 μm to 8 μm when observing the surfaces of the toner particles using the scanning electron microscope (SEM). From the TEM photographs of cross-sections of toner particles in the toner of Example 1 as shown in FIG. 2, it was confirmed that the outer surfaces of the shell layers of the toner particles in the toner of Example 1 are smooth, cracks in a direction approximately perpendicular to the surfaces of the toner core particles exist inside the shell layers of the toner particles in the toner of Example 1, and the shell layers of the toner particles in the toner of Example 1 have convex parts at the sides of the inner surfaces between two cracks. Since the structures of the shell layers of toner particles in the toners of Examples 2 and 3 were similar to the structures of the shell layers of toner particles in the toner of Example 1 when observing the cross-sections of toner particles in the toners of Examples 2 and 3 using the TEM, no TEM photograph was taken for the cross-sections of toner particles in the toner of Examples 2 and 3.

In regards to the toner particles in the toner of Comparative Example 1, it was confirmed that the surfaces of toner core particles were coated with resin fine particles maintaining a spherical particle state with respect to the toner particles having a particle diameter from 6 μm to 8 μm when observing their surfaces using the SEM. From the TEM photographs of cross-sections of toner particles in the toner of Comparative Example 1 as shown in FIG. 3, it was confirmed for the toner particles in the toner of Comparative Example 1 that the surfaces of toner core particles were coated with resin fine particles maintaining a particle state.

In regards to the toner of Comparative Example 2, the structures derived from spherical resin fine particles could not be observed at the surfaces of the shell layers with respect to the toner particles having a particle diameter from 6 μm to 8 μm when observing the surface of the toner particles using the SEM. From the TEM photographs of cross-sections of the toner particles in the toner of Comparative Example 2 as shown in FIG. 4, it was confirmed that the outer surfaces of the shell layers of the toner particles in the toner of Comparative Example 2 were smooth. However, from the TEM photographs of cross-sections of the toner particles in the toner of Comparative Example 2, it could be confirmed that cracks in a direction approximately perpendicular to the surfaces of the toner core particles did not exist inside the shell layers of the toner particles in the toner of Comparative Example 2.

In the toner particles included in the toners of Examples 1 to 3 and Comparative Examples 1 and 2, when the surfaces thereof were observed using an SEM, no magnetic powder was observed. In the toner particles included in the toner of Comparative Example 3, when the surfaces thereof were observed using an SEM, magnetic powder was observed.

It was confirmed from the TEM photographs of the cross-sections of the toner particle included in the toner of Comparative Example 3 as shown in FIG. 5 that the magnetic powder had been exposed on the outer surface of the shell layer of the toner particle included in the toner of Comparative Example 3.

Evaluation

The following methods were used to evaluate the fixability and heat-resistant storage stability, as well as the image density and toner charge amount in a prescribed environment, for the toners of Examples 1 to 3 and Comparative Examples 1 to 3.

Evaluation results of the toners are shown in Table 2. A page printer (FS-C4020N, by Kyocera Document Solutions Inc.) modified so as to allow temperature control for evaluation was used as an evaluation apparatus. The evaluation apparatus was allowed to stand in a power-off state for 10 minutes and then powered up for use.

Fixability

An image for evaluation was obtained in an environment of ordinary temperature and ordinary humidity (20° C., 65% RH) by using an evaluation apparatus and setting the fixing temperature to 200° C. The image density before friction of the image obtained for evaluation was measured with a Gretag Macbeth SpectroEye (manufactured by Gretag Macbeth).

Then, the image for evaluation was rubbed using a 1 kg weight coated with a fabric. Specifically, the image for evaluation was rubbed by reciprocating the weight 10 times on the image for evaluation in a way that only its own weight was applied thereto. An image density of the image for evaluation after rubbing was measured using the Gretag Macbeth SpectroEye. A fixation ratio was calculated from the image densities before and after rubbing of the image for evaluation in accordance with the formula shown below. From the calculated fixation ratio, fixability was evaluated on the basis of the criteria below. Evaluation of "good" was determined to be OK.

Fixation Ratio (%)=(image density after rubbing)/(image density before rubbing)×100

Good: fixation ratio of no less than 95%;

Neutral: fixation ratio of no less than 90% and less than 95%; and

Bad: fixation ratio of less than 90%.

Heat-Resistant Storage Stability

A toner was stored at 50° C. for 100 hours. Next, the toner was screened using a sieve of 140 mesh (opening 105 μm) under a condition of rheostat scale 5 and period 30 seconds in accordance with a manual of a powder tester (by Hosokawa Micron Co.). After the screening, a mass of the toner remaining on the sieve was measured. From the mass of the toner before the screening and the mass of the toner remaining on the sieve after the screening, an agglomeration degree (%) of the toner was determined in accordance with the formula shown below. From the calculated agglomeration degree, heat-resistant storage stability was evaluated on the basis of the criteria below. Evaluation of "good" was determined to be OK.

(Formula for Calculating Agglomeration Degree)
Agglomeration Degree (%)=(mass of the toner remaining on the sieve)/(mass of the toner before the screening)×100

Good: agglomeration degree of no greater than 20%;

Neutral: agglomeration degree of greater than 20% and no greater than 50%; and

Bad: agglomeration degree of greater than 50%. Image densities and toner charge amount in predetermined environments According to the following methods, the initial toner charge amount and image density, as well as the toner charge amount and image density after continuous image formation, were evaluated in respective environments of ordinary temperature and ordinary humidity (20° C., 65% RH) and high temperature and high humidity (32.5° C., 80% RH).

Image Density

An evaluation apparatus was used to form a pattern for image evaluation on a recording medium at a fixing temperature of 220° C. to give an initial image. Thereafter continuous image formation was carried out on 100,000 sheets at a coverage rate of 4%, and a pattern for image evaluation was then formed on a recording medium to thereby give an image after continuous image formation. The image densities of the solid images in the initial image and the image after the continuous image formation were each measured by using a reflection density meter (RD914 (manufactured by Gretag Macbeth)). The image densities were evaluated according to the following criteria. Evaluation of "good" was determined to be OK.

Good: 1.22 or more.

Neutral: below 1.22 and 1.20 or more.

Bad: below 1.20.

Charge Amount

After the formation of the initial image, the initial charge amount of the toner was measured. Subsequently, continuous image formation was conducted on 100,000 sheets at a coverage rate of 4%, and thereafter the charge amount of the toner was measured after continuous image formation. The charge amount was measured by using a charge amount measurement apparatus (Q/M Meter 210HS (manufactured by TRek)).

It is understood from Examples 1 to 3 that a toner including the toner particles that satisfy the following requirements (a) to (c) has excellent fixability and heat-resistant storage stability, and that, in the case where an image is formed by using such toner, the toner particles are charged at a desired charge amount during image formation in an environment of ordinary temperature and ordinary humidity or an environment of high temperature and high humidity over a long time period, and thus an image having a desired image density can be formed for a long time period.

(a) Toner particles containing toner core particle containing at least a binder resin and a magnetic powder, and shell layer coating the entire surface of the toner core particle, which is formed by using resin fine particles.

(b) In the case of observation by using a scanning electron microscope, the magnetic powder is not observed on the

TABLE 2

| | | Examples | | | Comparative Examples | | |
|---|---|---|---|---|---|---|---|
| | | 1 | 2 | 3 | 1 | 2 | 3 |
| Magnetic powder | | | | | | | |
| Type | | A | B | C | A | A | D |
| Average particle diameter (μm) | | 0.20 | 0.05 | 1.02 | 0.20 | 0.20 | 1.10 |
| Shape | | Octahedral | Spherical | Octahedral | Octahedral | Octahedral | Octahedral |
| Production conditions | | | | | | | |
| Rotation numbers (rpm) | | 10,000 | 10,000 | 10,000 | 5,000 | — | 10,000 |
| Treatment period (min) | | 10 | 10 | 10 | 5 | — | 10 |
| Evaluation | | | | | | | |
| Exposure of the magnetic powder on the outer surfaces of the shell layers | | Absence | Absence | Absence | Absence | Absence | Presence |
| Fixability | | | | | | | |
| Fixation ratio (%) | | 96 | 96 | 97 | 98 | 93 | 97 |
| Result | | Good | Good | Good | Good | Neutral | Good |
| Heat-resistant storage stability | | | | | | | |
| Agglomeration degree (%) | | 16.3 | 16.8 | 17.2 | 58.2 | 12.1 | 32.4 |
| Result | | Good | Good | Good | Bad | Good | Neutral |
| Initial image in ordinary temperature and ordinary humidity (20° C., 65% RH) | Image density | 1.35 | 1.34 | 1.37 | 1.20 | 1.34 | 1.25 |
| | Result | Good | Good | Good | Good | Good | Good |
| | Charge amount (μC/g) | 9.7 | 9.5 | 9.8 | 7.1 | 9.8 | 8.3 |
| Image after continuous image formation in ordinary temperature and ordinary humidity (20° C., 65% RH) | Image density | 1.30 | 1.29 | 1.31 | 1.02 | 1.33 | 1.22 |
| | Result | Good | Good | Good | Neutral | Good | Good |
| | Charge amount (μC/g) | 9.2 | 9.3 | 9.1 | 4.2 | 9.5 | 7.3 |
| Initial image in high temperature and high humidity (32.5° C., 80% RH) | Image density | 1.25 | 1.24 | 1.26 | 0.98 | 1.28 | 1.20 |
| | Result | Good | Good | Good | Bad | Good | Good |
| | Charge amount (μC/g) | 7.6 | 7.6 | 7.3 | 3.9 | 8.1 | 7.2 |
| Image after continuous image formation in high temperature and high humidity (32.5° C., 80% RH) | Image density | 1.20 | 1.21 | 1.22 | 0.79 | 1.25 | 1.10 |
| | Result | Good | Good | Good | Bad | Good | Neutral |
| | Charge amount (μC/g) | 7.1 | 7.2 | 7.4 | 2.5 | 7.6 | 5.5 |

surfaces of the shell layers, and approximately spherical particles derived from the resin fine particles are not observed on the surfaces of the shell layers of toner particles having a particle diameter in a specific range.

(c) In the case where the cross-sections of the toner particles are observed using a transmission electron microscope, cracks in a direction approximately perpendicular to the surface of the toner core particle are observed inside the shell layer.

It is understood from Comparative Example 1 that a toner with good heat-resistant storage stability is unlikely to be obtained when the structures derived from spherical resin fine particles are observed at the surfaces of the shell layers coating the toner core particles.

In the case where structures derived from spherical resin fine particles are observed on the surfaces of the shell layers, gaps remain between the resin fine particles that have been deformed to some extent and that coat the toner core particle. Therefore, it may be estimated that components such as the release agent included in the toner core particles readily bleed onto the surfaces of the toner particles included in the toner of Comparative Example 1.

Furthermore, in the case of the formation of an image by using the toner of Comparative Example 1, it was impossible to form images having a desired image density over a long time period in an environment of ordinary temperature and ordinary humidity or an environment of high temperature and high humidity. It is believed that this defect was caused by the following. In the toner particles contained in the toner of Comparative Example 1, approximately spherical particles derived from the resin fine particles are present on the surfaces of the shell layers. Therefore, in the case where an image is formed over a long time period by using the toner of Comparative Example 1, when undue stress is applied to the toner particles, the shell layers are readily peeled off the toner core particles. When peeling of the shell layers occurs, the toner particles are difficult to charge at a desired charge amount because of the exposure of the magnetic powder on the surfaces of the toner core particles.

It was confirmed from SEM observation of the toner particles of the toners of Example 1 and Comparative Example 1 that as the rotation number of the device for forming the shell layer is increased, smoothness of the resulting surfaces of the shell layers becomes better.

It is understood from Comparative Example 2 that when cracks in a direction approximately perpendicular to the surfaces of the toner core particles are not observed inside the shell layer, fixability of the resulting toner is poor.

This is believed to be due to the fact that the shell layers do not readily break under the pressure applied to the fixing nip of a fixing unit.

It is understood from Comparative Example 3 that when the magnetic powder is exposed on the surfaces of the toner particles, it is difficult to obtain a toner that has an excellent heat-resistant storage stability and can form an image having a desired image density in the case where image formation is carried out in an environment of high temperature and high humidity over a long time period. It is believed that a decrease in the heat-resistant storage stability of the toner occurs because air spaces form around sites where the magnetic powder of the shell layers is exposed, and components such as the release agent contained in the toner core particles bleed onto the surfaces of the toner particles from these air spaces. In the toner particles included in the toner of Comparative Example 3, emission of the electrification charge from the magnetic powder exposed on the surfaces of the toner particles occurs readily. Therefore, it is believed that, in the case where an image is formed in an environment of high temperature and high humidity over a long time period by using the toner of Comparative Example 3, the toner particles are difficult to charge at a desired charge amount, and thus an image having a desired image density is difficult to form.

Examples 4 and 5

Preparation of Toner Particles

The toners of Examples 4 and 5 were obtained in a manner similar to Example 1, except that resin fine particles of the kinds described in Table 3 were used.

Evaluation

For the toners of Examples 4 and 5, the above-mentioned fixability and heat-resistant storage stability were evaluated by the following method, and the image densities and toner charge amount at the initial stage, after recovery from sleeping and after continuous image formation, in a predetermined environment, were also evaluated. For the toner of Example 1, the image density and toner charge amount in a predetermined environment were evaluated by the following method. The results of the evaluations of the respective toners are described in Table 3. As the evaluation apparatus, a page printer (FS-C4020N (manufactured by Kyocera Document Solutions Inc.)) that had been modified to be able to adjust fixing temperatures for the evaluation was used. The evaluation apparatus was allowed to stand in a power-off state for 10 minutes, and then switching on the machine. Image densities and toner charge amounts in predetermined environments According to the following methods, the initial toner charge amounts and image densities, as well as the toner charge amounts and image densities after recovery from sleeping and after continuous image formation, were evaluated in respective environments of ordinary temperature and ordinary humidity (20° C., 65% RH) and high temperature and high humidity (32.5° C., 80% RH).

Image Density

The evaluation apparatus was used to form a pattern for image evaluation on a recording medium at a fixing temperature of 220° C. to give an initial image.

Thereafter continuous image formation was carried out on 50,000 sheets at a coverage rate of 4%, and the evaluation apparatus was left in a sleeping state for 12 hours. After standing, an image-evaluation pattern was formed on a recording medium to give an image after recovery from sleeping. Furthermore, an evaluation apparatus filled with new toner that had not been used for image formation was used to carry out continuous image formation on 100,000 sheets at a coverage rate of 4%, and, after continuous image forming, an image-evaluation pattern was formed on a recording medium to give an image after continuous image formation.

The image densities of the solid images in the initial pattern for image evaluation and the pattern for image evaluation after recovery from sleeping and after the continuous image formation were each measured by using a reflection density meter (RD914 (manufactured by Gretag Macbeth)). The image densities were evaluated according to the following criteria. Evaluation of "good" was determined to be OK.

Good: 1.22 or more.

Neutral: below 1.22 and 1.20 or more.

Bad: below 1.20.

(Charge Amount)

After the formation of the initial image, the initial charge amount of the toner was measured.

Subsequently, an image was obtained after recovery from sleeping, and the charge amount of the toner after recovery from sleeping was measured.

Subsequently, continuous image formation was conducted on 100,000 sheets at a coverage rate of 4%, and thereafter the charge amount of the toner was measured after continuous image formation. The charge amount was measured by using a charge amount measurement apparatus (Q/M Meter 210HS (manufactured by TRek)).

TABLE 3

| | | Examples | | |
|---|---|---|---|---|
| | | 4 | 5 | 1 |
| Type of resin fine particles | | B | C | A |
| Magnetic powder | | | | |
| Type | | A | A | A |
| Average particle diameter (μm) | | 0.2 | 0.2 | 0.2 |
| Production conditions | | | | |
| Rotation numbers(rpm) | | 10,000 | 10,000 | 10,000 |
| Treatment period(min) | | 10 | 10 | 10 |
| Evaluation | | | | |
| Exposure of the magnetic powder on the outer surfaces of the shell layers | | Absence | Absence | Absence |
| Fixability | | | | |
| Fixation ratio (%) | | 91 | 98 | 96 |
| Result | | Good | Good | Good |
| Heat-resistant storage stability | | | | |
| Agglomeration degree (%) | | 12.0 | 14.0 | 16.3 |
| Result | | Good | Good | Good |
| Initial image in ordinary temperature and ordinary humidity (20° C., 65% RH) | Image density | 1.40 | 1.42 | 1.35 |
| | Result | Good | Good | Good |
| | Charge amount (μC/g) | 10.5 | −10.3 | 9.7 |
| Image after recovery from sleeping in ordinary temperature and ordinary humidity (20° C., 65% RH) | Image density | 1.25 | 1.30 | 1.20 |
| | Result | Good | Good | Good |
| | Charge amount (μC/g) | 9.2 | −9.8 | 8.0 |
| Image after continuous image formation in ordinary temperature and ordinary humidity (20° C., 65% RH) | Image density | 1.37 | 1.38 | 1.30 |
| | Result | Good | Good | Good |
| | Charge amount (μC/g) | 10.1 | −10.2 | 9.2 |
| Initial image in high temperature and high humidity (32.5° C., 80% RH) | Image density | 1.31 | 1.35 | 1.25 |
| | Result | Good | Good | Good |
| | Charge amount (μC/g) | 8.5 | −8.7 | 7.6 |
| Image after recovery from sleeping in high temperature and high humidity (32.5° C., 80% RH) | Image density | 1.22 | 1.25 | 1.10 |
| | Result | Good | Good | Neutral |
| | Charge amount (μC/g) | 8.1 | −8.3 | 5.9 |
| Image after continuous image formation in high temperature and high humidity (32.5° C., 80% RH) | Image density | 1.26 | 1.29 | 1.20 |
| | Result | Good | Good | Good |
| | Charge amount (μC/g) | 7.5 | −7.8 | 7.1 |

When the structures of the shell layers of the toner particles included in the toner of Examples 4 and 5 were observed by using an SEM and a TEM in a manner similar to that for the toner of Example 1, it was observed that no structures derived from the above-mentioned spherical resin fine particles were seen on the surfaces of the shell layers, the outer surfaces of the shell layers were smooth, and cracks each having a predetermined shape were present inside the shell layers.

When Examples 4 and 5 and Example 1 are compared, it is understood that, in the case where a toner containing toner particles having shell layers which are formed by using resin fine particles containing a charge-control resin is used, an image having a desired density can be formed, since the toner particles contained in the toner can be charged at a desired charge amount, even in the case where image formation is stopped once and thereafter image formation is restarted in an environment of high temperature and high humidity on the way of long term image formation.

The invention claimed is:

1. A magnetic toner for electrostatic latent image development including a plurality of toner particles, each of the plurality of toner particles comprising a toner core particle containing at least a binder resin and magnetic powder, and a shell layer coating the toner core particle, wherein:

the shell layer comprises spherical resin fine particles adhere to an entire surface of the toner core particle such that the spherical resin fine particles do not overlap in a direction perpendicular to the surface of the toner core particle, and a surface of the shell layer of the toner core particle, which is not contacting toner core particle, is free from the magnetic powder and is flattened such that an original shape of the spherical resin fine particles do not remain among the toner particles having a particle diameter from 6 μm to 8 μm and the shell layer further comprises cracks on a surface which is contacting toner core particle, the cracks are approximately perpendicular to a surface of the toner core particle and originate at phase boundaries of the resin fine particles themselves.

2. The magnetic toner for electrostatic latent image development according to claim 1, wherein the resin fine particles contain a charge-control resin.

3. The magnetic toner for electrostatic latent image development according to claim 1, wherein a thickness of the shell layer is from 0.045 μm to 0.3 μm.

4. The magnetic toner for electrostatic latent image development according to claim 1, wherein when cross-sections of each of the plurality of the toner particles is observed using a transmission electron microscope, a convex part, between two of the cracks, of the shell layer is observable on a phase boundary between the toner core particle and the shell layer.

5. The magnetic toner for electrostatic latent image development according to claim 1, wherein the magnetic powder has a particle diameter of 0.05 μm or more and 1.00 μm or less.

6. The magnetic toner for electrostatic latent image development according to claim 1, wherein the shell layer is formed using a method including the steps of I) and II) below:

I) a step of making spherical resin fine particles adhere to the surface of the toner core particle so as to not overlap thereon in a direction perpendicular to the surface of the toner core particle and forming a layer of the resin fine particles that covers the entire surface of the toner core particle, and II) a step of smoothening the outer surface of the layer of the resin fine particles to thereby form the shell layer by applying an external force to the outer surface of the layer of the resin fine particles and deforming the resin fine particles in the layer of the resin fine particles.

* * * * *